US005918101A

United States Patent [19]

Kuroyanagi

[11] Patent Number: 5,918,101

[45] Date of Patent: Jun. 29, 1999

[54] IMAGE FORMING APPARATUS

[75] Inventor: Satoshi Kuroyanagi, Inagi, Japan

[73] Assignee: Canon Kabushiki Kaisha, Tokyo, Japan

[21] Appl. No.: 08/688,642

[22] Filed: Jul. 29, 1996

[30] Foreign Application Priority Data

Jul. 28, 1995 [JP] Japan ..... 7-193766

[51] Int. Cl.[6] ..... G03G 15/00

[52] U.S. Cl. ..... 399/407; 270/32; 270/37; 399/17; 399/410; 399/370

[58] Field of Search ..... 399/17, 365, 367, 399/370, 373, 376, 407, 408, 410; 270/32, 37, 45; 271/3.01, 3.14, 3.15, 9.06

[56] References Cited

U.S. PATENT DOCUMENTS

| | | | |
|---|---|---|---|
| 5,008,709 | 4/1991 | Shinada et al. | 399/86 |
| 5,032,876 | 7/1991 | Murakami | 399/410 |

FOREIGN PATENT DOCUMENTS

| | | |
|---|---|---|
| 60-102365 | 6/1985 | Japan . |
| 60-232372 | 11/1985 | Japan . |
| 60-263534 | 11/1986 | Japan . |
| 62-059002 | 3/1987 | Japan . |
| 02152864 | 6/1990 | Japan . |
| 2-198974 | 8/1990 | Japan . |
| 03183596 | 8/1991 | Japan . |
| 03184064 | 8/1991 | Japan . |
| 03184065 | 8/1991 | Japan . |
| 3-184064 | 8/1991 | Japan . |
| 3-184065 | 8/1991 | Japan . |

OTHER PUBLICATIONS

Patent Abstracts of Japan, vol. 14, No. 399 (M–1017), Aug. 29, 1990 JP 2–152864 (Canon Inc.).

Patent Abstracts of Japan, vol. 15, No. 437 (M–1176), Nov. 7, 1991 JP 3–183596 (Mita Ind. Co. Ltd).

Patent Abstracts of Japan, vol. 15, No. 439, (P–1273), Nov. 8, 1991 JP 3–184064 (Mita Ind Co. Ltd).

Patent Abstracts of Japan, vol. 15, No. 439 (P–1273), Nov. 8, 1991 JP 3–184065 (Mita Ind. Co. Ltd).

"Document Size Recognition" Research Disclosure, No. 329, Sep. 1, 1991 p. 695.

*Primary Examiner*—Matthew S. Smith

*Attorney, Agent, or Firm*—Fitzpatrick, Cella, Harper & Scinto

[57] ABSTRACT

An image forming apparatus includes a original stacking tray capable of stacking a plurality of originals; feeding means for feeding the original one by one; means for detecting sizes of the originals; image forming means for reading an image of the original and for forming an image on a sheet having a corresponding size as the original; means for folding the sheet on which the image is formed by the image forming means, into a size; means for selecting operation or non-operation of the folding means; stacking means for stacking the sheet folded or not folded by the folding means; and control means operative in a mixed original mode in which the originals on the stacking tray have different sizes, the control means, in the mixed original mode, effects the image formations on the sheets having sizes corresponding to the sized detected by the detecting means and causes the folding means to operate when the size is large and causes the stacking means to discharge both of the folded and non-folded sheets to the stacking means.

21 Claims, 26 Drawing Sheets

IMAGE FORMING APPARATUS

FIELD OF THE INVENTION AND RELATED ART

The present invention relates to a sheet folding apparatus, and an automatic original feeding apparatus. More specifically, it relates to an image forming apparatus whose main assembly comprises an automatic original feeding apparatus which automatically feeds an original to an image processing section, and a sheet processing apparatus which folds, sorts, processes, stacks, and holds the sheets outputted from an image forming apparatus after image formation.

In a conventional image forming apparatus equipped with an automatic original feeding apparatus and a postprinting sheet processing apparatus, the sheets, on which the image of the original automatically fed by the automatic orignal feeding apparatus has been formed, are sorted into a bin (accumulating means) or bins of a sheet processing apparatus located on the downstream side of the sheet flow, and are accumulated therein. The sheets accumulated in the bin, constituting a sheet set, are bound by a processing apparatus. Thereafter, the bound sheets (sheet set) are held on a stacker.

When the sheets in the original placed on the original table of the automatic original feeding apparatus are different in size, that is, when a mixed original mode is used, the size of the sheet in the original is detected by a size detecting means each time the sheet is fed from the original placement table, and thereafter, a recording sheet having the size matching the detected size of the sheet fed from the original is fed. The recording sheet outputted after image formation is sequentially accumulated on the accumulating means of the sheet processing apparatus.

However, the aforementioned conventional image forming apparatus had a problem in that when in the mixed sheet size mode, recording sheets of various sizes (for example, A4 and A3 sizes) are mixedly outputted into the sheet processing apparatus, making it difficult to accumulate or bind the outputted sheets, since the outputted sheets had the different sizes matching the sizes of the sheets in the original.

SUMMARY OF THE INVENTION

The primary object of the present invention is to provide an image forming apparatus capable of equalizing, in size in terms of the projection area, the sheets outputted from the apparatus operated in a mixed sheet size mode, and accumulating them on the same accumulating means.

According to an aspect of the present invention, an image forming apparatus comprises an accumulating means for accumulating the discharged sheets, an original placement table capable of accommodating an original containing multiple sheets, a separating-conveying means for separating the sheets in an original one by one, and conveying them to an image processing section, a size detecting means for detecting the size of the sheet contained in the original, and a folding means for folding the sheet discharged from the main assembly of the image forming apparatus to a predetermined size, wherein when the apparatus is in a mixed sheet size mode, that is, when an original containing sheets of different sizes is placed on the original table, the size of the sheet from the original is detected by the size detecting means, and the image of the sheet from the original is formed on a recording sheet having the size matching the detected size of the corresponding sheet from the original, and after image formation, the thus fed large size recording sheet is folded by the folding means, so that the large and small sheets can be accumulated on the same accumulating moans, whereas when the size detecting means detects, before the beginning of the actual image formation, that the original contains only sheets of the smaller size, the apparatus carries out a normal image forming operation without selecting the mixed sheet size mode.

With the provision of the above structure, when an image forming operation is carried out in the mixed sheet size mode, the size of each sheet of the original is detected by the sheet size detecting means, and the recording sheet matching the sheet size of each sheet of the original is fed to the image forming section; therefore, even if a set of original mixedly contains large size sheets and small size sheets (for example, A3 size and A4 size), the sheets having corresponding sizes are automatically fed, and are discharged onto an accumulating means to be accumulated thereon.

The sheets having been accumulated as a set of sheets on the accumulating means are processed by the sheet processing means, and then are delivered to the stacking means to be held thereon.

When a sheet of the original is determined to have the larger size by the size detecting means, a recording sheet correspondent to the detected large size is delivered to the image forming section, and is discharged as a large size copy after being folded into a predetermined size (for example, the same size as the smaller size) by the folding apparatus, and is accumulated on the same accumulating means as the accumulating means on which a sheet of the smaller size is accumulated.

Therefore, the discharged sheets (copies) having various sizes can be given the same size in terms of projection area, and be accumulated on the same accumulating means, being enabled to be handled together in processing, conveying, and stacking.

Incidentally, when in the mixed size mode, the feeding of the original may be started after the sizes of all the sheets in the original are detected. In this case, when it is detected that the original contains the sheets of the large size as well as the sheets of the small site, the mixed sheet size mode is carried out, and the thus produced copies are discharged onto the accumulating means after being folded, whereas when it is detected that all the sheets in the original are the small size sheets, the mixed sheet size mode is cancelled, and the small size recording sheets are successively fed for image formation. As a result, image formation can be carried out without reducing the image formation efficiency. In other words, when in the mixed sheet size mode, the size of each sheet in an original is detected, and the recording sheet feeding is started after the size of the corresponding sheet from the original is detected; therefore, the copying speed decreases. After the mixed sheet size mode is cancelled, the sheet size detection is carried out only once, allowing the recording sheet to be fed without the delay for the sheet size detection for each sheet of the original; therefore, the copying speed increases.

As described above, according to the present invention, recording sheets having various sizes can be discharged as if they have the same size in terms of the projection area, and can be properly accumulated on the same accumulating means, making it possible to process all together the discharged copies with different sizes and conveying them to the stacking means, without the need for handling them separately.

Further, even when the mixed sheet size mode has been selected for the apparatus, the sizes of all the sheets in an original is detected by the size detecting means before the actual image formation begins, in order to confirm whether the mixed sheet size mode is to be continued or not, and when only the smaller size is detected, it is possible to eliminate the operational sequence in which each recording sheet is fed only after the size of the correspondent sheet in the original is confirmed. As a result, the speed at which the recording sheet is fed to the image forming section can increased.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

General Structure

Figure 1:
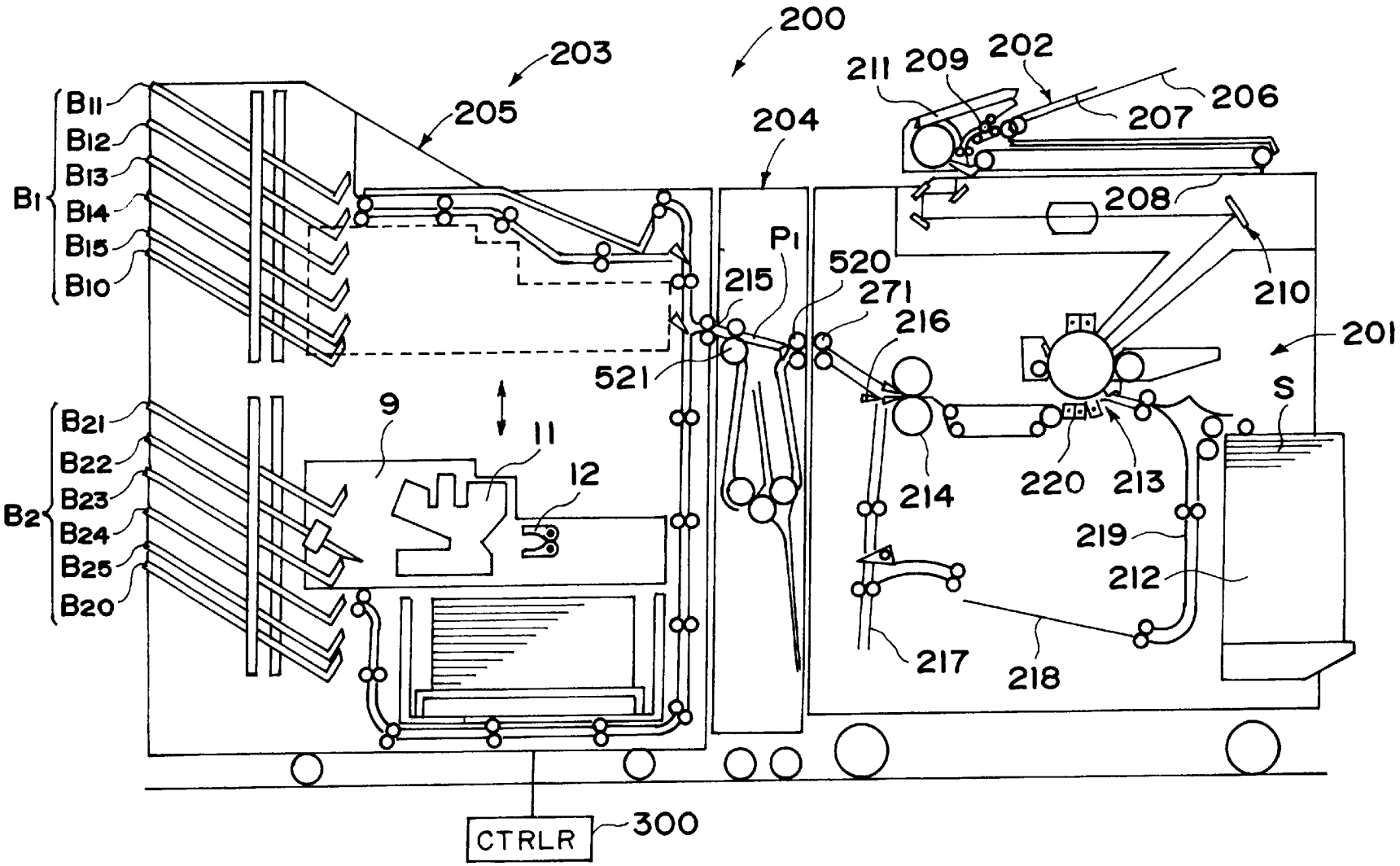
FIG. 1 is a longitudinal schematic section of an image forming apparatus, depicting the main assembly, the automatic original feeding apparatus connected to the main assembly, and the sheet processing apparatus also connected to the main assembly.

FIG. 1 illustrates an electro-photographic copying machine 200 (image forming apparatus) as a sheet outputting apparatus.

The electro-photographic copying machine 200 comprises an automatic original feeding apparatus 202 disposed on the main assembly of the copying apparatus, and a sheet processing apparatus 203 disposed next to the copying apparatus main assembly 201, on the side where a sheet S is discharged, and the sheet processing apparatus 203 comprises a folding apparatus 204 and a stapling-stacking apparatus 205.

The sheets in an original 207 placed in an original placing table 206 of the original feeding apparatus 202 are sequentially separated by a separating-conveying roller 209 from the bottom side thereof. The separated original sheet is fed by way of a conveyer belt onto the platen glass 208 of the copying machine main assembly 201, where it is read by the optical system 210 of the copying machine main assembly 201. Then, the conveyer belt is driven in reverse, whereby the original sheet is conveyed from the platen glass 208, through a path 211, back to the original placing table 206, where it is placed on the uppermost sheet of the original set.

The sheet S is fed from a deck 212 to an image forming section 213, where it receives an image, and then, it is fixed in a fixing section 214. The fixed sheet S is discharged (outputted) from the copying machine main assembly 201 by a discharge roller (discharging mess) 271. Thereafter, it is sent straight through a folding apparatus, which normally is not activated, to the sheet entrance 215 of the stapling-stacking apparatus 205.

At this time, the image forming process of the copying machine 200, which is the mother machine for the sheet processing apparatus, will not be described since it is a matter of public knowledge.

General Structure of Stapling-Stacking Apparatus

Figure 2:
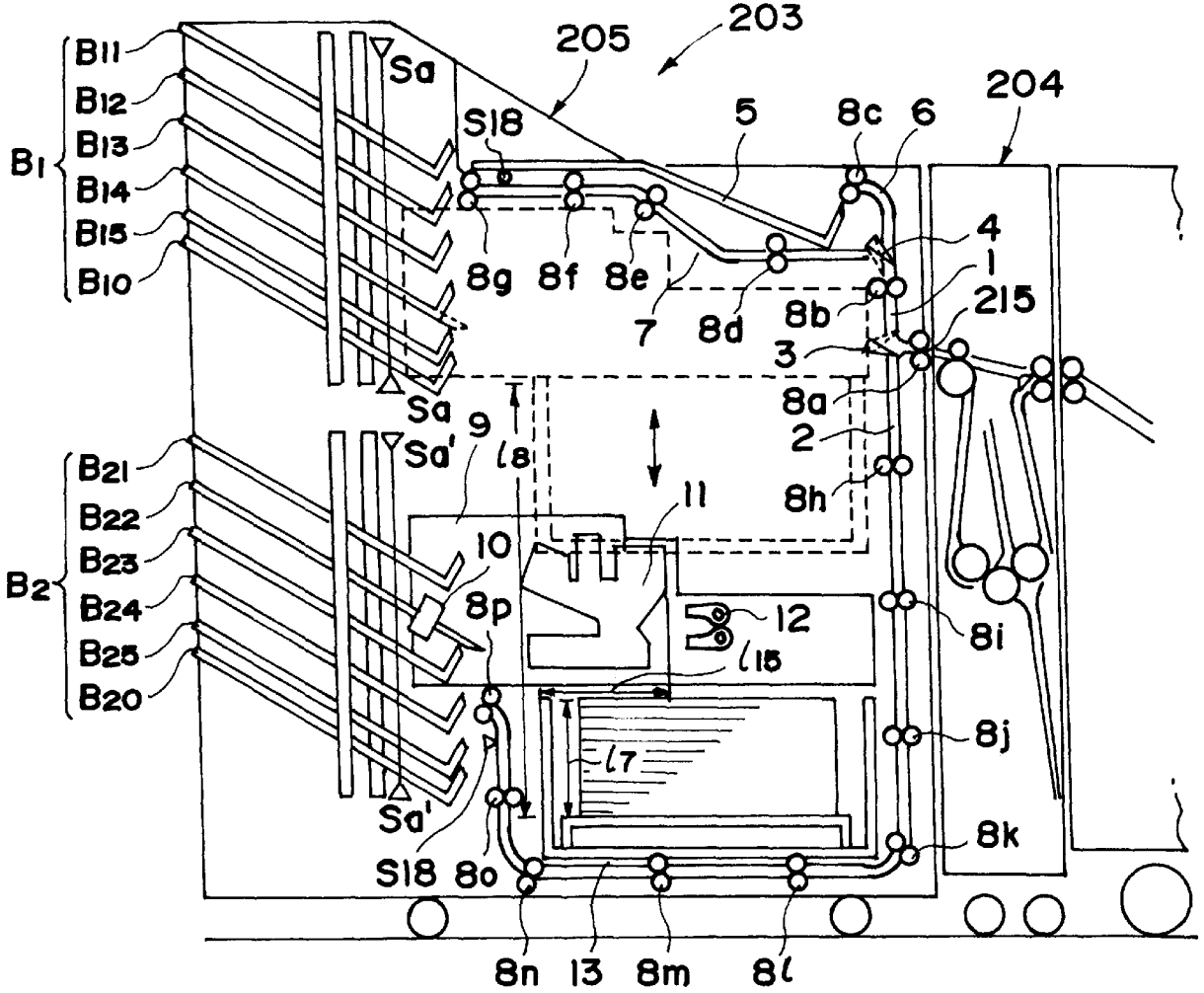
FIG. 2 is a longitudinal schematic section of the sheet processing apparatus in FIG. 1.

Referring to FIGS. 1 and 2, the stapling-stacking apparatus 205 comprises bin modules B1 and B2 arranged in the vertical direction. The bin module B1 comprises a plurality of bins B1l–B1n (sorting-accumulating means), and the bin module B2 also comprises a plurality of bins B2l–B2n (in the drawings, n=6). The bin modules B1 and B2 can be independently moved to dispose one of their own bins at a sheet receiving position or a sheet set transferring position, and also, the bin intervals and bin position in each bin module can be varied, independently of the other bin module.

There are two sheet delivery paths, the first sheet delivery path 1 that leads upward and the second sheet delivery path 2 that leads downward, which branch out from the sheet entrance 215. The sheet advancing direction is switched at the sheet entrance 215 by a deflector 3 driven by a unillustrated solenoid SL3. The first path 1 branches into a sheet delivery path 6 leading to a non-sort tray (means for accumulating without sorting) 5 and a sheet delivery path 7 leading to a top module B1, at the location of a deflector 4 driven by a unillustrated solenoid SL4. The second path 2 serves by itself as the path to a bottom module B2.

Therefore, the sheet to be delivered to the non-sort tray is conveyed by roller pairs 8*a*, 8*b* and 8*c*; the sheet to be delivered to the top module, by roller pairs 8*a*, 8*b*, and 8*d*–8*g*; and the sheet to be delivered to the bottom module is conveyed by roller pairs 8*a*, and 8*h*–8*p*.

The stapling-stacking apparatus comprises a gripping-stapling unit 9, which is disposed in a space formed between the path to the top module and the path to the bottom module, wherein the sheet set on each bin is moved rightward (in FIGS. 1 and 2) by a tip advancing gripper (first conveying means) 10, is selectively stapled by a stapler (processing means) 11, and then, is moved further rightward by a transfer gripper (second gripping means) 12 that grips the tip of the sheet set.

Also in the same space between the path to the top module and the path to the bottom module, a stacking unit (stacking means) 13 is waiting below the gripping-stapling unit 9, and stores the sheet set transferred thereon by the transfer gripper 12.

Referring to FIG. 2, the right end portion of the stapler (processing means) 11 and the left end portion of the stacking unit (stacking means) 13 overlap (by a length designated by $1_{15}$) in the horizontal direction.

After the bins B11–B16 of the top module are filled with a set of sheets, the gripper-stapler unit 9 is moved to a position indicated by a broken line in FIGS. 1 and 2 to transfer the sheet set out of the bins. While the sheet sets are transferred from the top module, the sheet is delivered to the bins B21–B26 of the bottom module. After the completion of both the sheet set transfer from the bins B11–B16, and the sheet delivery to the bins B21–B26 of the bottom module, the sheet sets are transferred from the bottom module at a position indicated by a solid line in FIG. 1 and FIG. 2. This operation can be repeated to continue the copying operation till the stacking unit becomes full.

Detailed Structure of Stapling-Stacking Apparatus

The folding apparatus mentioned in the above description is the same as the one disclosed in Japanese Laid-Open Patent Application Nos. 232,372/1986 or 59,002/1987; therefore, its description will be concise.

The folding apparatus can be operated in the following modes.

The first mode is a non-processing mode in which folding is not required, and a sheet is simply passed through the folding apparatus. In this mode, the recording sheet taken in by an entrance roller pair 520 (FIG. 1) is led into a sheet path P1 by the operation of an entrance deflector, and then is delivered to a finisher apparatus 203.

Figure 22:
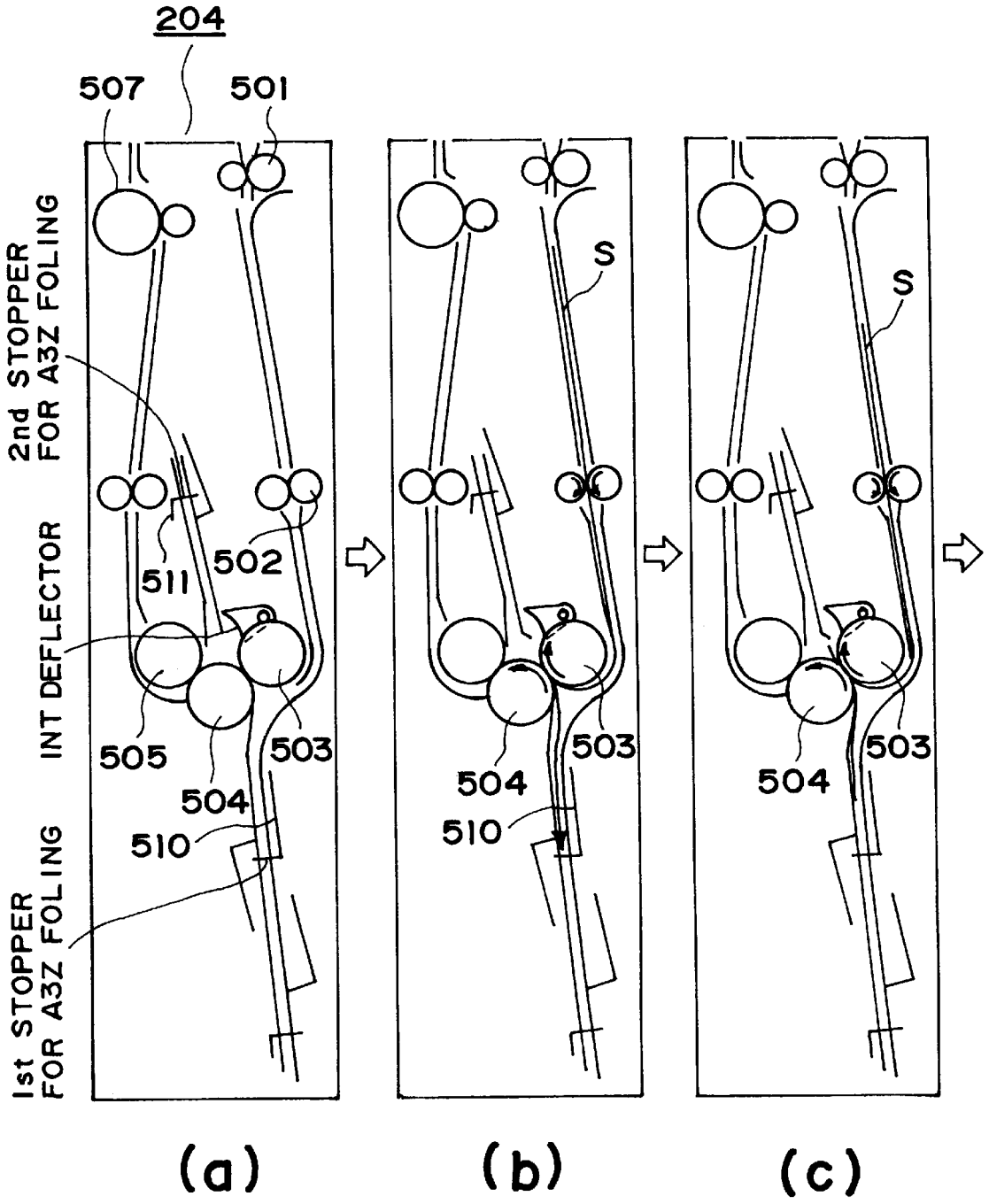
FIGS. 22(*a*), 22(*b*), and 22(*c*) comprise a schematic side view of the folding apparatus, describing the folding operation thereof.

The Z-folding mode is a mode in which the recording sheet is first folded into halves, and then, one of the halves is folded back in the direction opposite to the first folding. In this mode, the recording sheet introduced into the sheet path by the entrance roller pairs 520 and 501, and the entrance deflector, is first introduced into a folding path by the operation of the deflector (FIG. 22(*a*)). As the leading tip of the recording sheet 2 comes in contact with a stopper projection 510 driven by a solenoid, the recording sheet 2 forms a loop, the location of which is approximately ¼ the length of the recording sheet 2 from the leading tip (FIG. 22(*b*)). This looped portion of the recording sheet 2 is pinched by the nip formed between folding rollers 503 and 504, being formed into a first folded edge.

Figures 23A, 23B, 23C:
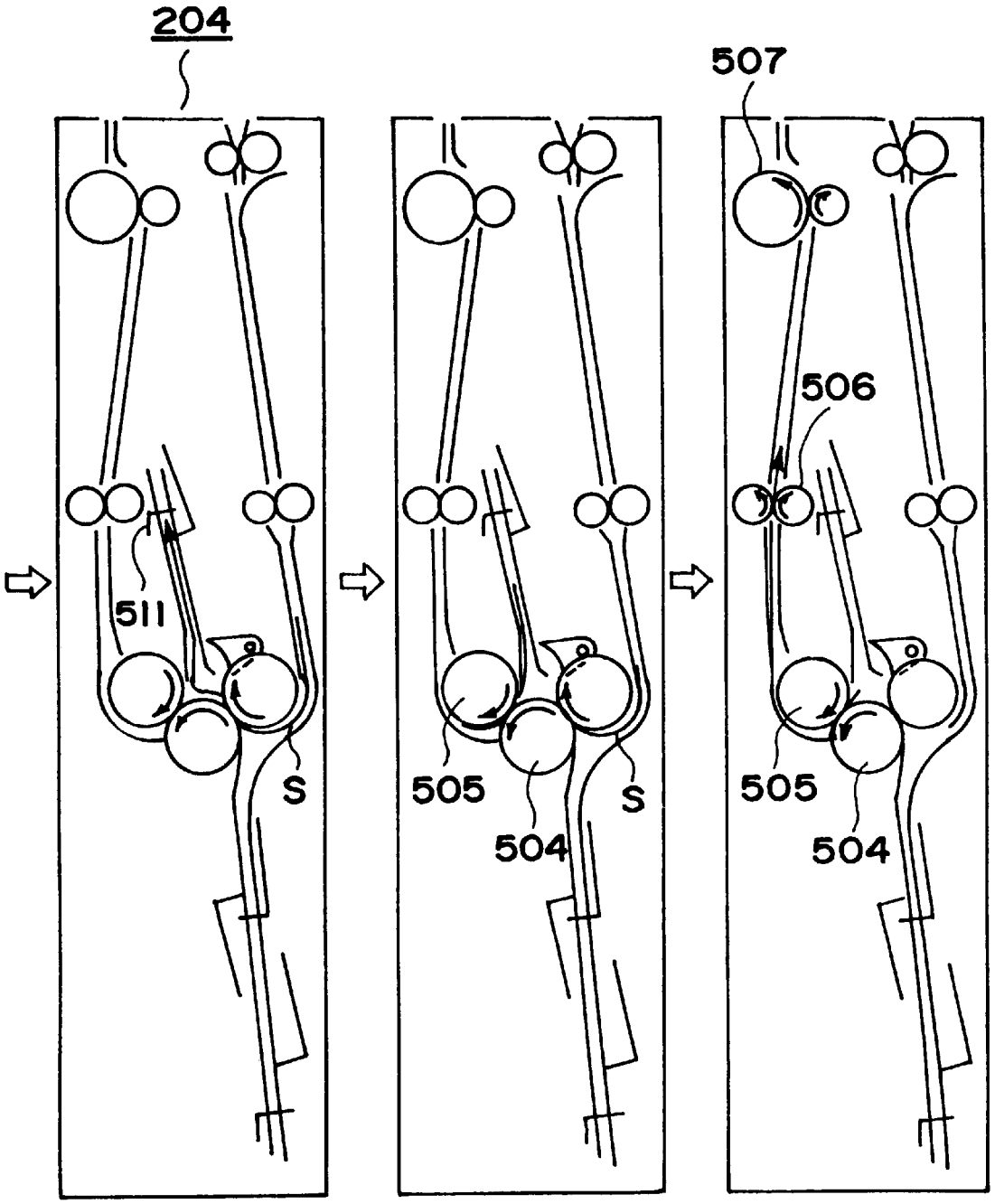
FIGS. 23(*a*), 23(*b*), and 23(*c*) comprise a schematic side view of the folding apparatus, describing the folding operation succeeding the folding operation described in FIG. 22.

Next, the thus folded recording sheet is led into another folding path by another deflector. As the first folded edge of the recording sheet is caused to butt a stopper 511 (FIG. 23(*a*)), the recording sheet forms another loop, the location of which is approximately ¼ the length of the recording sheet 2 from the folded edge of the recording sheet 2 toward the trailing end of the recording sheet 2. This loop is pinched by the nip formed between folding rollers 504 and 505, being formed into a second folded edge (FIG. 23(*b*)). Consequently, the recording sheet 2 is Z-folded. Next, the Z-folded recording sheet 2, the trailing portion of which has been folded onto the front side, is introduced between a roller pair 506 and 507 by the operation of another deflector, is passed through another path, and is discharged into the finisher apparatus by a discharge roller pair 521.

Figure 26:
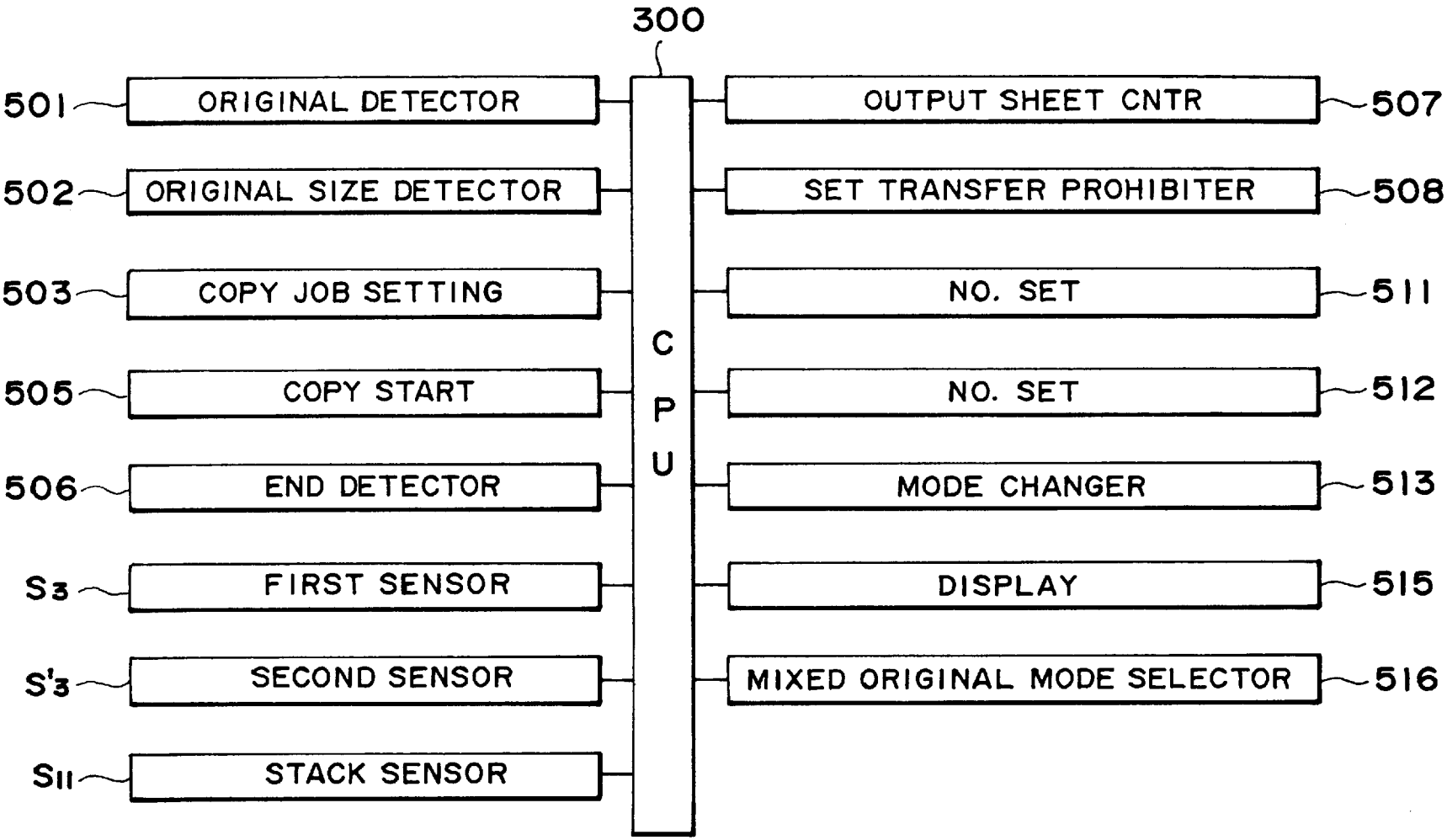
FIG. 26 is a block diagram for controlling the image forming apparatus in accordance with the present invention.

Next, the copying machine control that characterizes the present invention will be described with a block diagram given in FIG. 26.

In the drawing, a reference numeral designates a sensor 501 for detecting whether or not an original 207 is present on an original placement table 206; 502, a means for detecting the size of the sheet contained in the original 207, which is disposed in the sheet path to determine the size (for example, A3, A4, A4, etc.) of the original sheet delivered from the original placement table 206 by measuring the passing time of the original sheet; 503, a means for setting a type of copy job (for example, margin setting inclusive of a binding margin); 505, a copy start button for starting a copying operation in the copying machine main assembly 201; 506, a means for detecting the completion of the operation of the processing means such as a stapler 11; S3, a first transmission sensor for detecting the presence or absence of the sheet in the bin module B1; S3', a second transmission sensor for detecting the presence or absence of the sheet in the bin module B2; S11, a sensor attached to the stacker to detect the presence or absence of the sheet set in the stacker unit 13; 507, a means for counting the number of the sheets discharged from the copying machine main assembly 201; 508, a means for preventing different sheets or sheets sets having already been accumulated from shifting while they are accumulated; 511, a means for setting the number of copy sets to be made by the copying machine main assembly 201; 512, a means for setting a smaller number of copying operations than a predetermined number (for example, when 10 sets of copies are to be taken, the finishing is effected for every 2 sets); 513, a means for switching between a mode in which a sheet is sorted and accumulated on top of the preceding sheet having already been sorted and accumulated in an accumulating means, and a mode in which a sheet is discharged into another accumulating means; 515, a means for displaying various conditions to be set for the copying apparatus, or the messages from the apparatus; and a reference numeral 516 designates a button for selecting the mixed sheet size mode, which is pressed by an operator when the operator visually determines that the original contains sheets of various sizes. When in the normal mode, the size detecting means 502 detects the size of only the first sheet from the original, and thereafter, it does not detect the sheet size; the second sheet and thereafter are processed as a sheet having the same size as the first sheet.

Next, the operational flow of the present invention will be described with reference to the flowchart given in FIG. 24.

Figure 24:
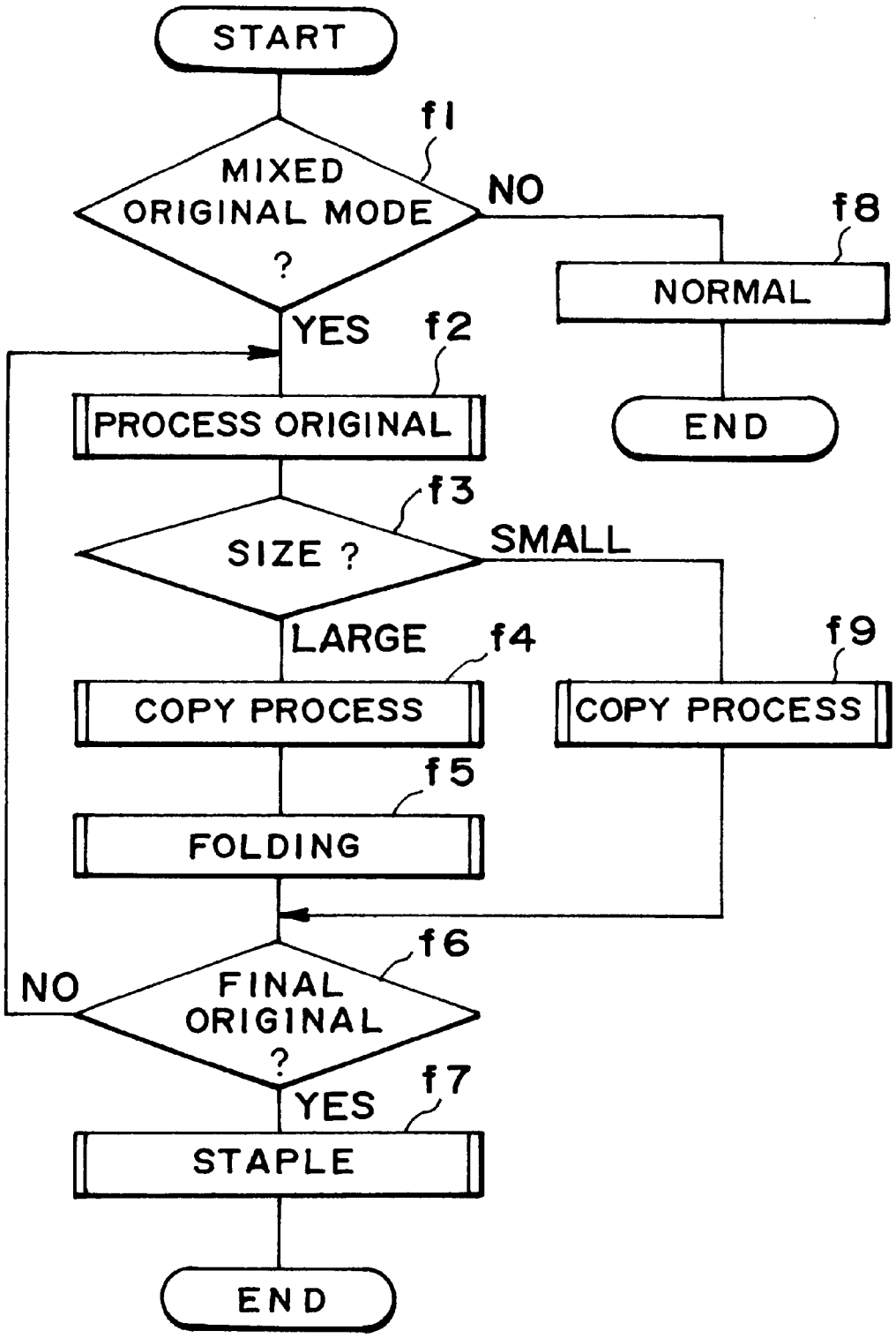
FIG. 24 is a flowchart of the operation of the image forming apparatus.

In a step f1 in FIG. 24, whether the apparatus is in the mixed sheet size mode or not is checked. When not in the mixed sheet size mode, a normal process is carried out in a step f8. Whether the mixed sheet size mode has been selected or not depends on whether the mixed mode has been selected by an operator or not.

When in the mixed sheet size mode, an original sheet is fed in a step f2. At this time, the size of the original sheet is confirmed.

When it is determined in a step f3 that the size of the original sheet is as small as the A4 size, a copy is made in a step f9. When it is determined that the size of the original sheet is as large as the A3, a copy is made in a stop f4, and is discharged after it is folded in a step f5 to the same size as the small size.

Next, whether the fed original sheet is the last sheet or not is checked in a step f6. When it is not the last one, the operation returns to the stop f2 to repeat the steps described above. The sheet size detecting means 502 detects the size of each original sheet.

When it is determined in the step f6 that the fed sheet is the last one, the copies are processed by a stapler (processing means).

By this time, the discharged large size copy has been folded to the same size as the small sheet; therefore, the large size copy and the small size copy can be processed together; they can be handled together when they are stapled as a set by the stapler 11, and are conveyed to the stacking unit 13 by the conveyer gripper 12, in spite of a difference in actual size.

Other Embodiments

Referring to the flowchart given in FIG. 25, the operational flow of the present invention, which is different from the preceding one, will be described.

In a step f10, whether the apparatus is in the mixed sheet size mode or not is checked in the same manner as in the preceding embodiment. When not in the mixed sheet size mode, a copy is normally processed in a step f2l. When in the mixed sheet size mode, the operation goes to a step f11.

In the step f11, all the sheets in the original are fed to check their sizes.

When it is determined in the step f11 and a step f12 that at least one original sheet as large as the A3 is present among the original sheets, the mixed sheet size mode is continued without any change (size of each original sheet is detected). That is, the original is fed in a step f13; a copy is made in a step f14; and the copy is folded in a step f15 when the copy is of the large size. Further, whether the fed original sheet is the last one or not is checked in a step f16. When it is not the last one, the steps described above are repeated from the step f13. On the other hand, when the copy is of the small size, the folding step is skipped after the step f14, and the step f16 immediately follows.

When the fed original sheet is the last one, the copies are processed with the stapler 11 in a step f17. Even though the large size sheets and the small size sheets are mixedly discharged, the large size sheets have been folded to the same size as the small size sheets before the step f14; therefore, the large size copies and the small size copies can be handled together when they are stapled as a set, when they are conveyed as a processed sheet set to the stacking unit 13, or when they are subjected to the like processes, in spite of their difference in actual size.

On the other hand, when it is determined in the steps f11 and f12 that the size of the original sheet is only the small size, the mixed sheet size mode is cancelled since continuing the mode is a mistake. Then, a small size recording sheet is fed in a step f18, and a copy is made in a step f19. At this time, the size of only the first original sheet is checked. Further, whether the fed original sheet is the last one or not is determined in a step f20, and when the fed original sheet is not the last, the above steps are repeated from the step f18.

As described above, even when image formation is carried out in the mixed sheet size mode, when all the detected sizes are the small sizes, the recording sheet feeding operation does not need to be carried out in the mixed sheet size mode; therefore, the copying speed can be increased. This arrangement is effective in a situation such as when an operator forgets to cancel the mixed sheet size mode.

Figure 25:
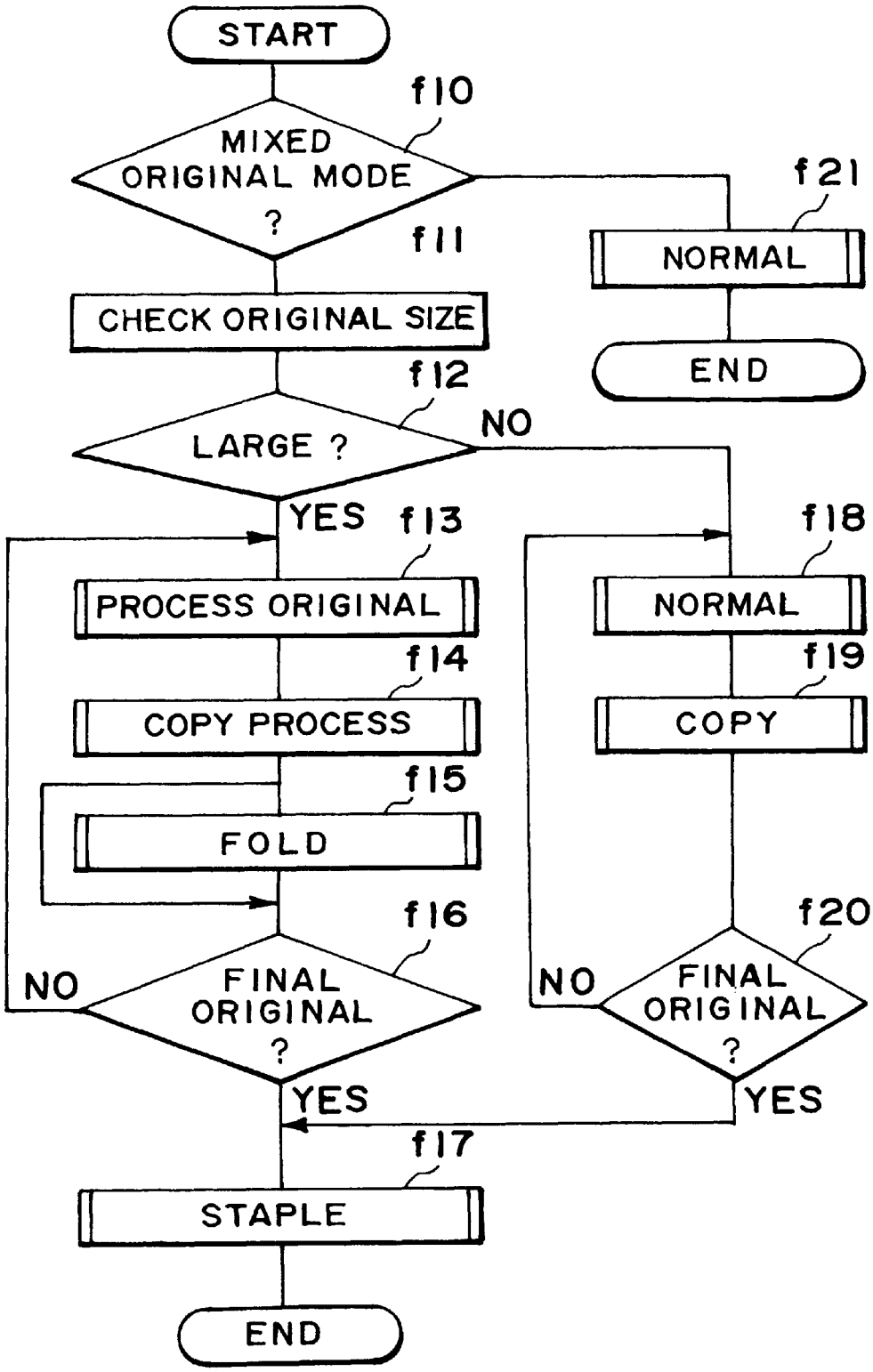
FIG. 25 is a flowchart of the operation of the image forming apparatus in another embodiment of the present invention.

Incidentally, in the embodiment depicted in FIG. 25, all the sheets in the original are circulated once to determine whether or not the original contains the sheets of various sizes, before a real image forming begins. However, the present invention is not limited by this embodiment.

For example, a detecting means capable of detecting the size of the original sheet may be provided on the original placement table so that whether or not the large size original sheet is mixed in the original can be determined simply by placing the original. More specifically, a reflection type sensor may be disposed at a location which is not covered by the trailing end of an A4 size original sheet, but is covered by the trailing end of an A3 size original sheet.

Figure 27:
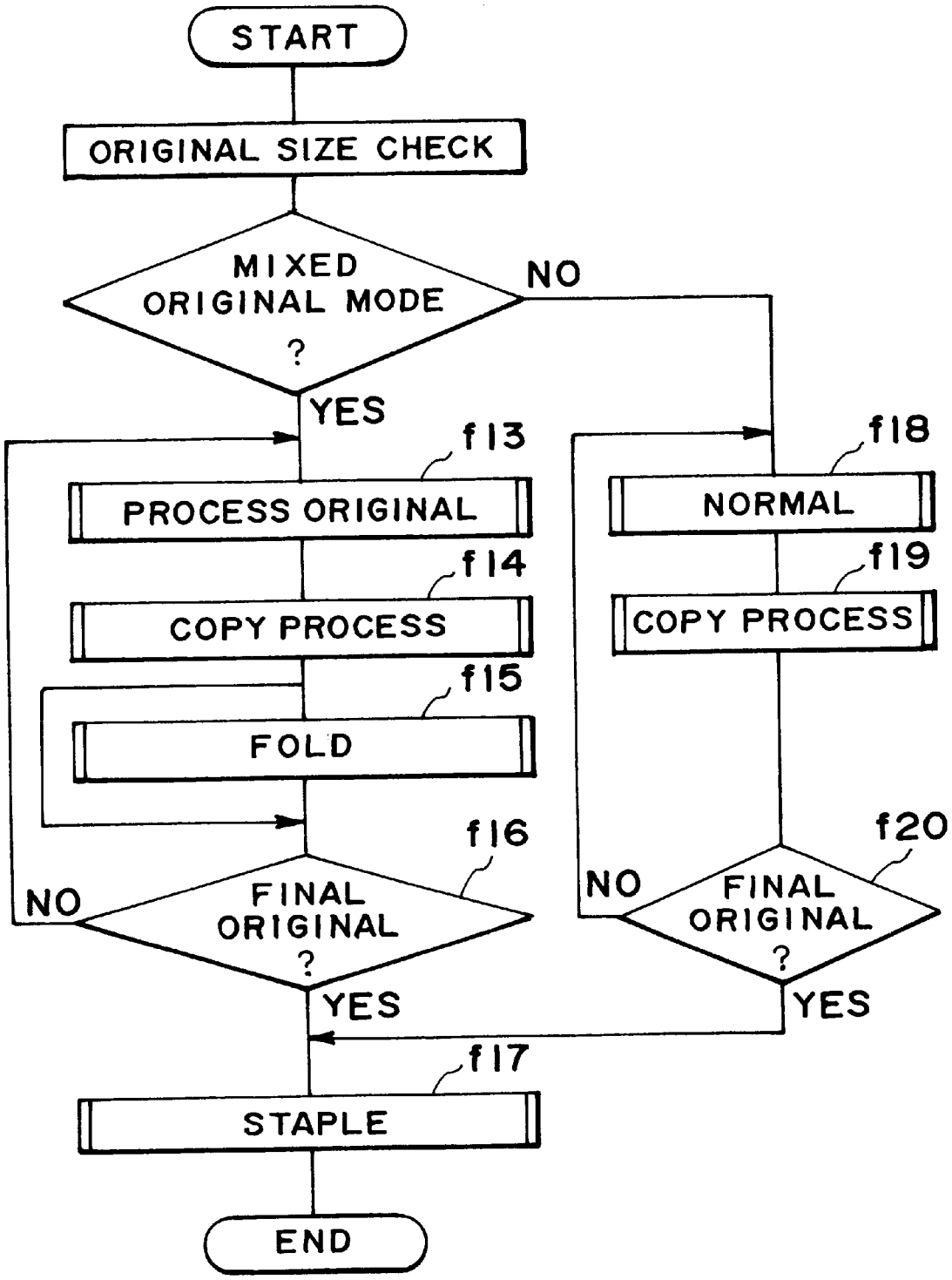
FIG. 27 is a flowchart for controlling the image forming apparatus in another embodiment of the present invention.

Also in the preceding embodiment, the mixed sheet size mode is inputted by an operator, but it does not need to be. For example, an arrangement may be made so that all the sheets in the original are fed to check the sizes of the sheets in the original before a real image formation, and when the presence of the sheets with various sizes, for example, A3 size sheets and A4 size sheets, is detected, the mixed sheet size mode is automatically selected (FIG. 27).

Next, the structure of each member or portion will be described in more detail.

To begin with, the bin modules B1 and B2 will be described.

Figure 3:
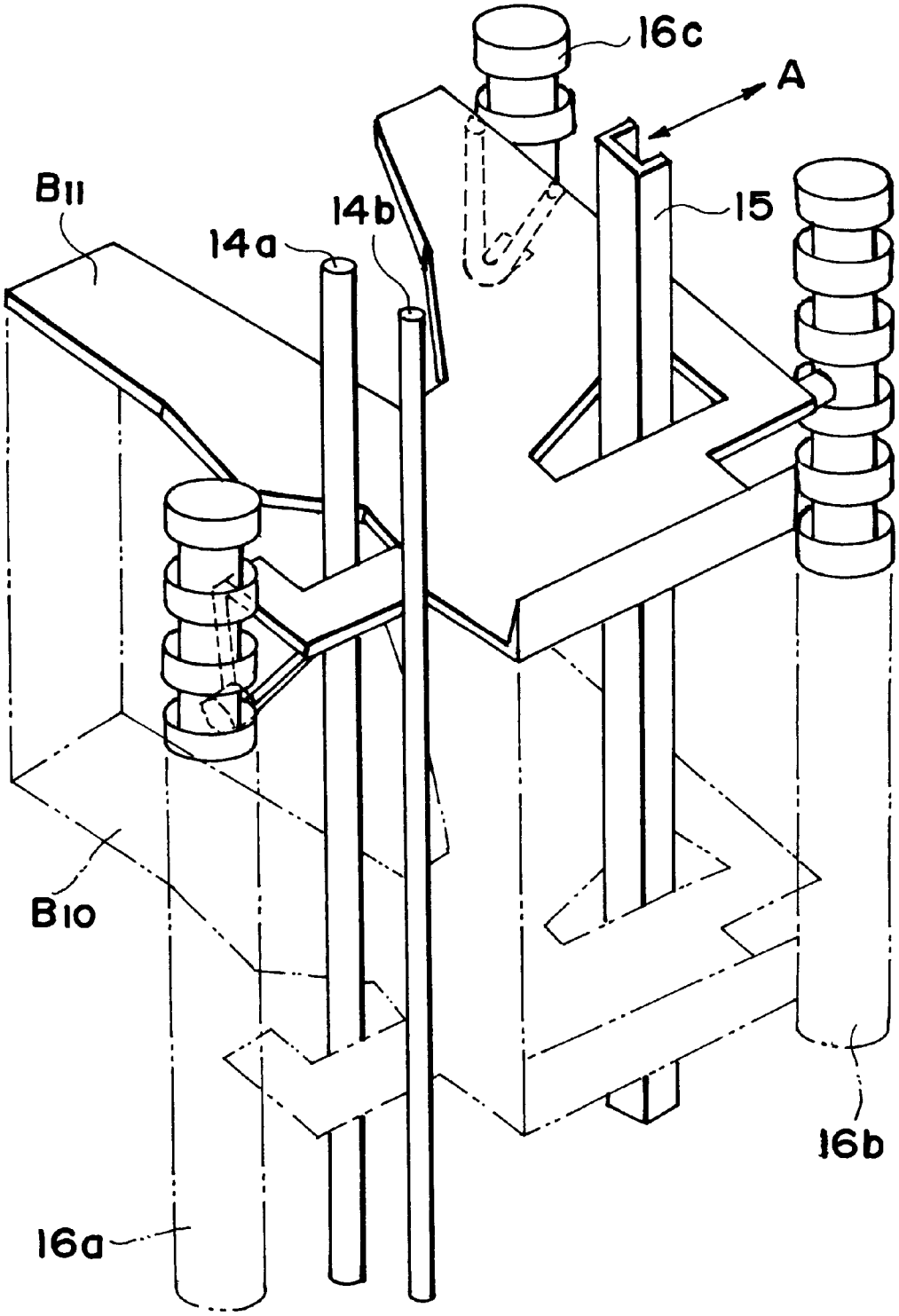
FIG. 3 is a perspective view of the bin module illustrated in FIG. 1.

FIG. 3 is a perspective view of the bin module. Below, the description will be given with reference to the module B1, and the same structure applies to the bin module B2.

The bin module B1 essentially comprises bins B1l–B1n, two reference rods 14*a* and 14*b*, an aligning wall 15, lead came 16*a*–16*c* for moving the bins vertically, and driving sections therefor. The reference rods 14*a* and 14*b* are the members that define the referential line for the sheet discharged onto the bin when the sheet processing such as stapling is carried out, and normally, it is disposed at a location retreated slightly from the point where the edge of the discharged sheet settles. The aligning wall 15 comes in contact with the edge of the sheet discharged onto the bin, and shifts the sheets in the direction perpendicular to the sheet delivery direction (direction indicated by an arrow A), one by one, or by two or more, whereby the sheet is aligned as the sheet edge opposite to the aligning wall 15 is abutted on the reference rods 4*a* and 4*b*.

Figure 4:
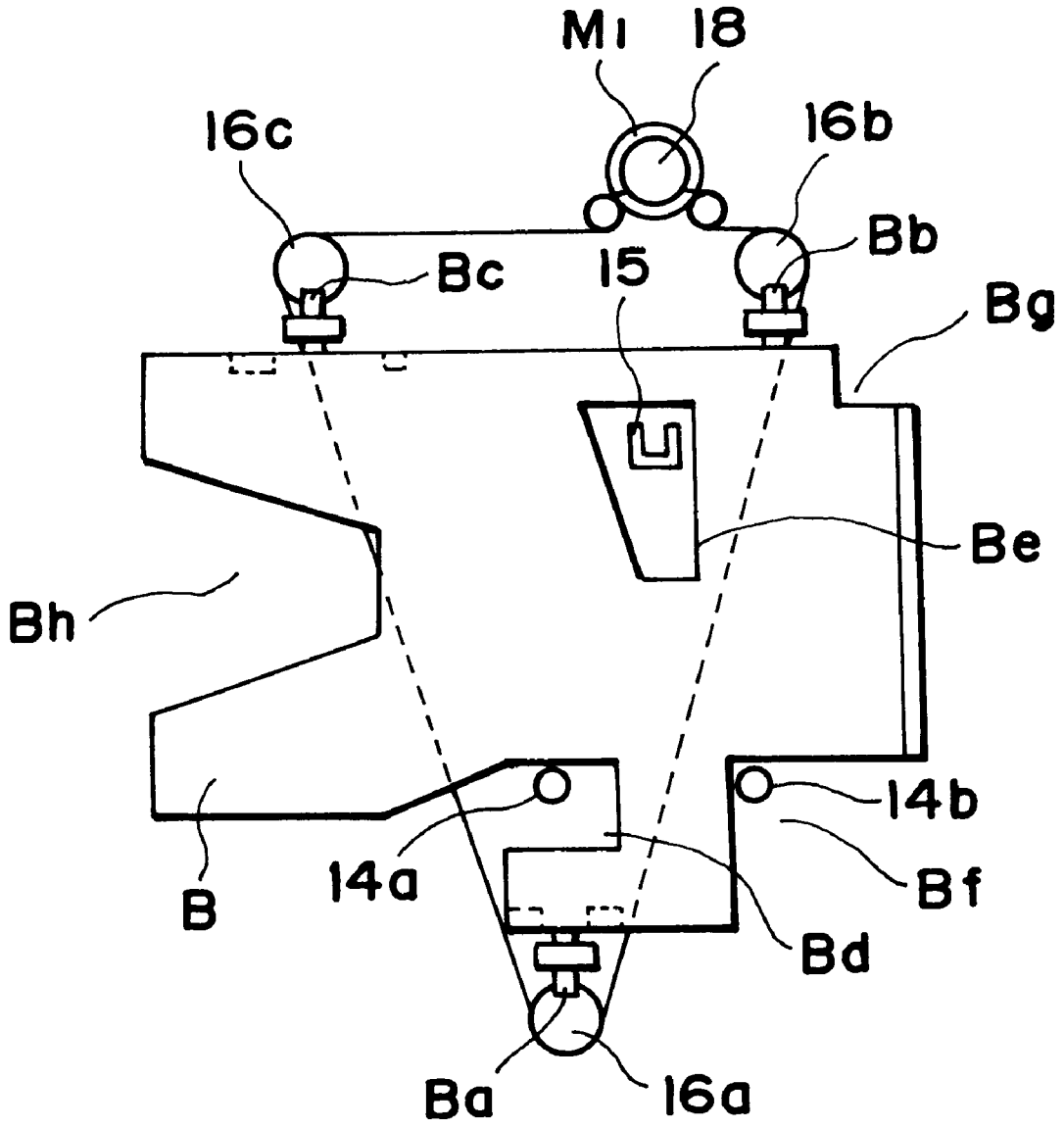
FIG. 4 is a plan view of the same bin module.

FIG. 4 is a top plan view of the bin module.

Referring to FIG. 3, and FIG. 4 which is a plan view of the bin module, the lead cam 16*a*, 16*b* or 16*c* is a spiral cam, the peripheral surface of which is provided with a spiral cam surface, wherein the cam 16*a* is disposed at the front, and the lead cams 16*b* and 16*c* are disposed at the rear. Each cam engages with correspondent roller Ba, Bb or Bc projecting from the bin; therefore, one synchronous rotation of the lead cam vertically moves the bins by a predetermined pitch.

Referring to FIG. 4, the bin has a cutaway portion Bd correspondent to the reference rod, a hole Be correspondent to the aligning wall, a cutaway portion Bf correspondent to the gripper, which will be described later, a cutaway portion Bg correspondent to the driving mechanism for erecting the vertical portion of the bin, and a cutaway portion Bh needed operationally.

Figure 5:
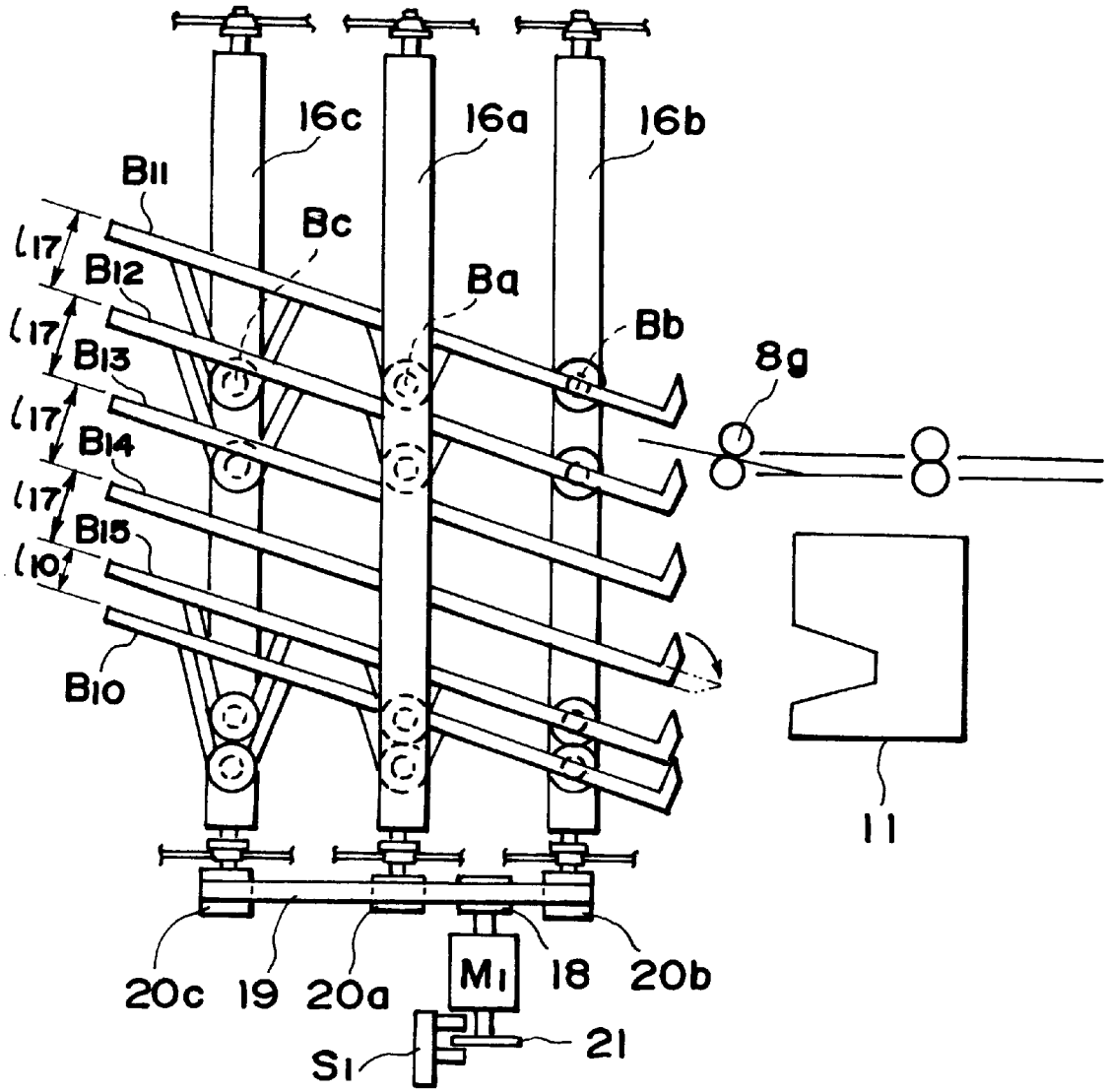
FIG. 5 is a front view of the same bin module.

FIG. 5 is a front view of the bin module.

In the drawing, the bins are vertically stacked in parallel, being slightly angled relative to the horizontal plane, whereas the bin rollers Ba, Bb and Bc are at the same height. More specifically, the position of the bin roller Bb attached toward the right end portion of the bin is next to the referential surface of the bin, whereas the position of the bin roller Bc attached toward the left and portion of the bin, using a V-shaped fixing arm, is substantially below the referential surface of the bin.

As is evident from FIGS. 1 and 2, between the top and bottom bin modules, the relationship between the sheet receiving position and the sheet set transfer position in the vertical direction is reversed, having merit in that both modules can share the same gripping-stapling unit 9 or stacking unit 13 when the sheet set is removed.

On the other hand, in the case of the bottom bin module, the relation between the sheet receiving position and sheet set transfer position is opposite to the one in the top module as is evident from FIGS. 1 and 2. Therefore, following the same chain of thought, in FIG. 2, the interval between the bin B24 at the sheet receiving position and bin B23 directly above needs to be as large as 117, being relatively large, and the intervals between the bin B22 at the sheet set transfer position and the bins B21 and B23 directly above and below, respectively, also need to be as large as 117, whereas the interval between the bins B24 and 525 does not need be as large as 117.

However, when the interval between the bins 224 and B25 is also increased to 117, the bin interval arrangement becomes identical for the top and bottom bin modules, admitting that the relation between the sheet receiving position and sheet set transfer position is reversed; in other words, the lead cam pitch that determines the bin interval may be the same for the top and bottom bin modules, which offers a merit in that a common lead cam can be used for the top and bottom bin modules. Further, the reversal arrangement of the sheet receiving position and sheet set transfer position between the top and bottom bin modules has additional merit in that the same gripping-stapling unit 9 and stacking unit 13 can be shared by the top and bottom bin module when the sheet is taken out.

Next, the bin shifting mechanism and its operation will be described (FIGS. 4 and 5).

The driving force from a bin shift motor M1 is synchronously transmitted to the lead cams 16*a*–16*c* by way of a motor pulley 18, a belt 19, and lead cam pulleys 20*a*–20*c*, wherein as the lead cam is rotated one rotation by the forward or backward rotation of the motor M1, the bins are vertically shifted by the amount equivalent to the cam pitch. Each lead cam is rotatively supported by its own bearing, and receives the driving force through the pulley 20 attached thereto, at the end opposite to the bearing. The bin shift motor M1 has an encoder 21 disposed on the side opposite to the pulley 18, and the number of rotations is detected by a sensor S1.

Each bin module has a home position detecting sensor S2 (unillustrated), which determines whether or not the uppermost bins B11 or B21 of the top or bottom bin module, respectively, are at the correspondent sheet receiving position. Each bin module also has a transmission type sensor Sa, Sa' (FIG. 2) for detecting the presence or absence of a sheet on the bin, and the signal from this sensor is used for determining the timing for switching the modules or the like purpose.

Next, the driving mechanism for the upright portion of the bin will be described. This upright portion of the bin serves as the aligning surface in the sheet delivery direction (FIG. 6).

This driving mechanism moves the upright portion of the bin when the sheet set accumulated on the bin must be moved past the location of the upright portion of the bin in order to process or stack it.

Figure 6:
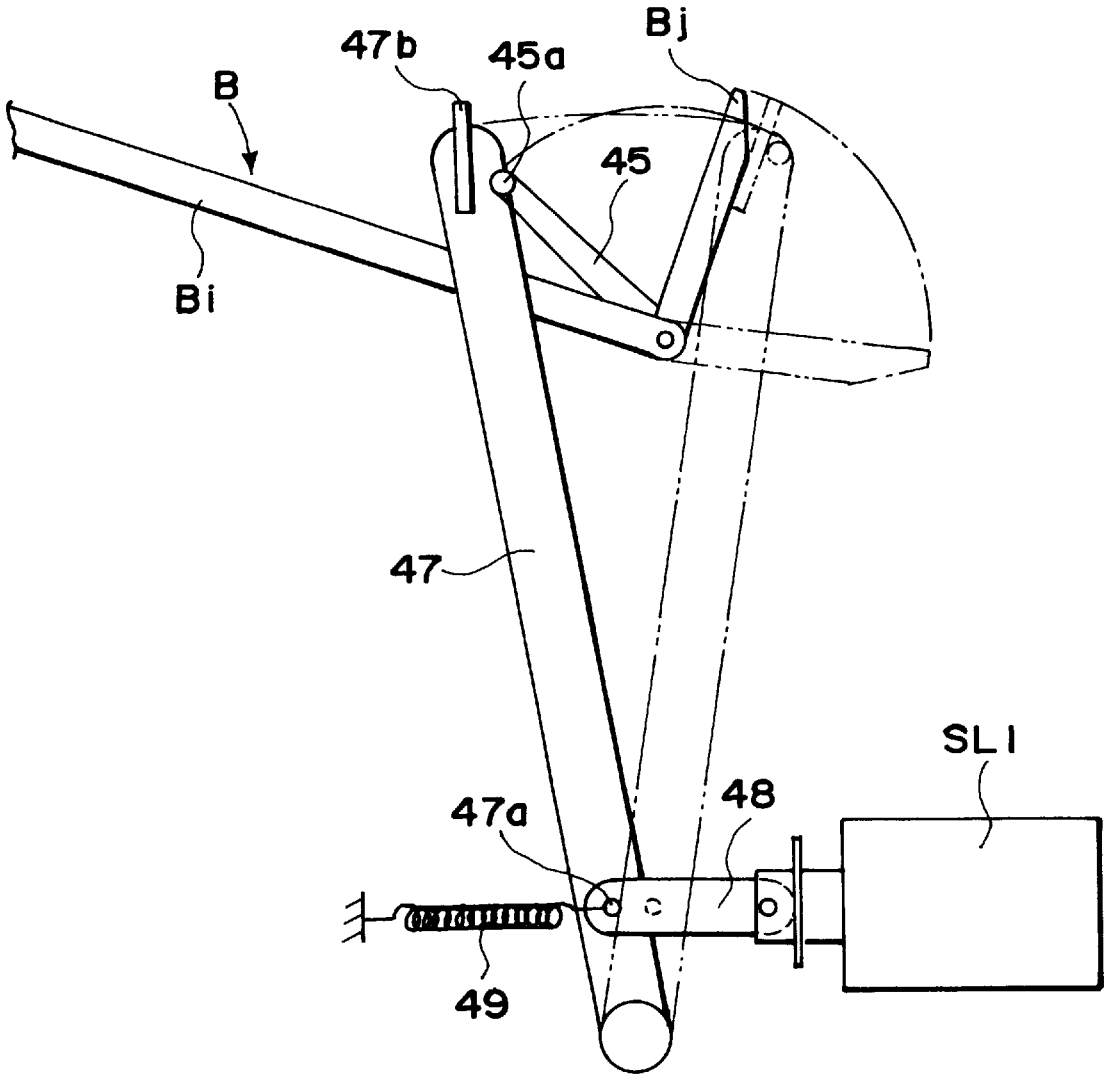
FIG. 6 is a side view of the driving portion of the upright portion of the same bin module.

FIG. 6 is a front view.

The bin B comprises a sheet accumulating portion Bi and an aligning portion Bj, wherein the rotational axis of the aligning portion Bj is rotatively fitted in the hole on the accumulating portion Bi side. As for the rotational angle of the aligning portion Bj, it is approximately 90° as illustrated in FIG. 6; in other words, the aligning surface perpendicular to the fixed accumulating surface can be rotated to become substantially level with the accumulating surface. Normally, the aligning portion Bj is placed under pressure from a spring or the like so that the accumulating surface and aligning surface remain perpendicular to each other (solid line in FIG. 6). The spring is strong enough to prevent the aligning portion Bj from being pushed down by the weight of the sheet get on the bin. Further, on the rear side of the aligning portion Bj, a driving arm 45 is attached, and a pin 45*a* is erected from the free end of the driving arm.

A solenoid SL1 for driving the upright portion of the bin is supported on a base. On the base, a link 47 is rotatively supported, and one end of an arm 48 is engaged with the pin 47*a* of the link 47. The other end of the arm 48 is attached to the solenoid SL1, and the link 47 is moved from a solid line position to a double dot chain line position by the solenoid activation. At the free end portion of the link 47, a contact member 47*b* is attached, wherein normally, there is enough of a gap between the contact member 47*b* and the pin 45*a*, so that the vertical movement of the bin B is not interfered with. When the sheet set is stacked after the completion of the sheet discharge onto the bin and the subsequent processing of the sheet set in the bin, the involved bin is shifted to a position illustrated in FIG. 6, and then, the solenoid SL1 is activated. The bin contact member 47*b* comes in contact with the pin 45*a*, and as the link 47 further rotates, the aligning portion Bj is moved to the double dot chain line position in FIG. 6. When the solenoid SL1 is deactivated, the link 47 returns to the solid line position by the function of a spring 49, allowing thereby the aligning portion Bj to return to the position where it becomes perpendicular to the sheet accumulating surface. Since the sheet set accumulated on the bin is not processed on the bin, the aligning portion Bj does not require a cutaway portion for processing. Therefore, the surface of the aligning portion Bj, which the sheet set butts, forms a continuous surface without any interruption.

With the provision of the above structure, a sheet set can be reliably aligned by the aligning portion Bj regardless of size variation, adding to the reliability of processing operation of the stapler 11 as the post-image formation processing means.

Figure 7:
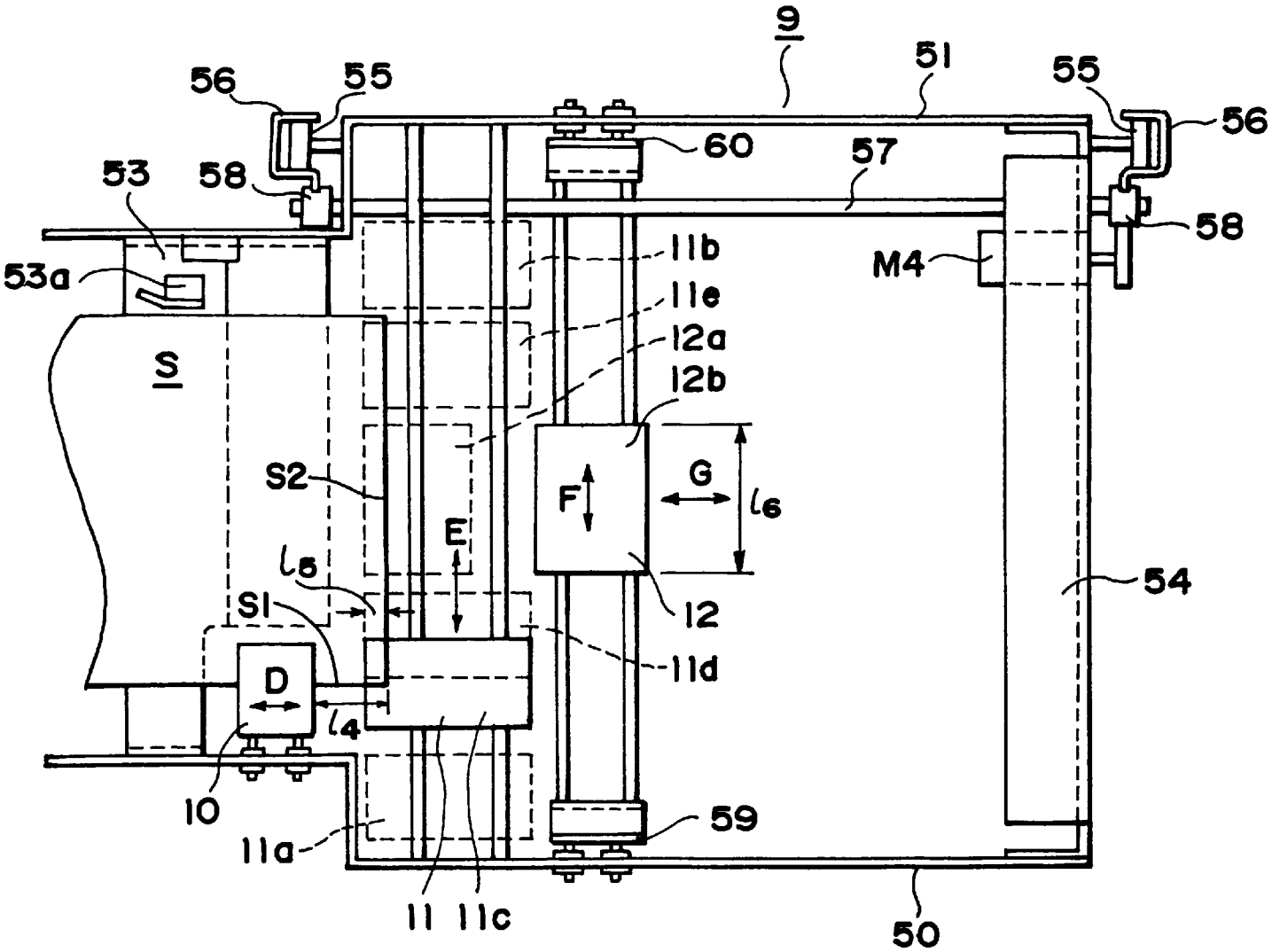
FIG. 7 is a plan view of a gripping-stapling unit.
Figure 8:
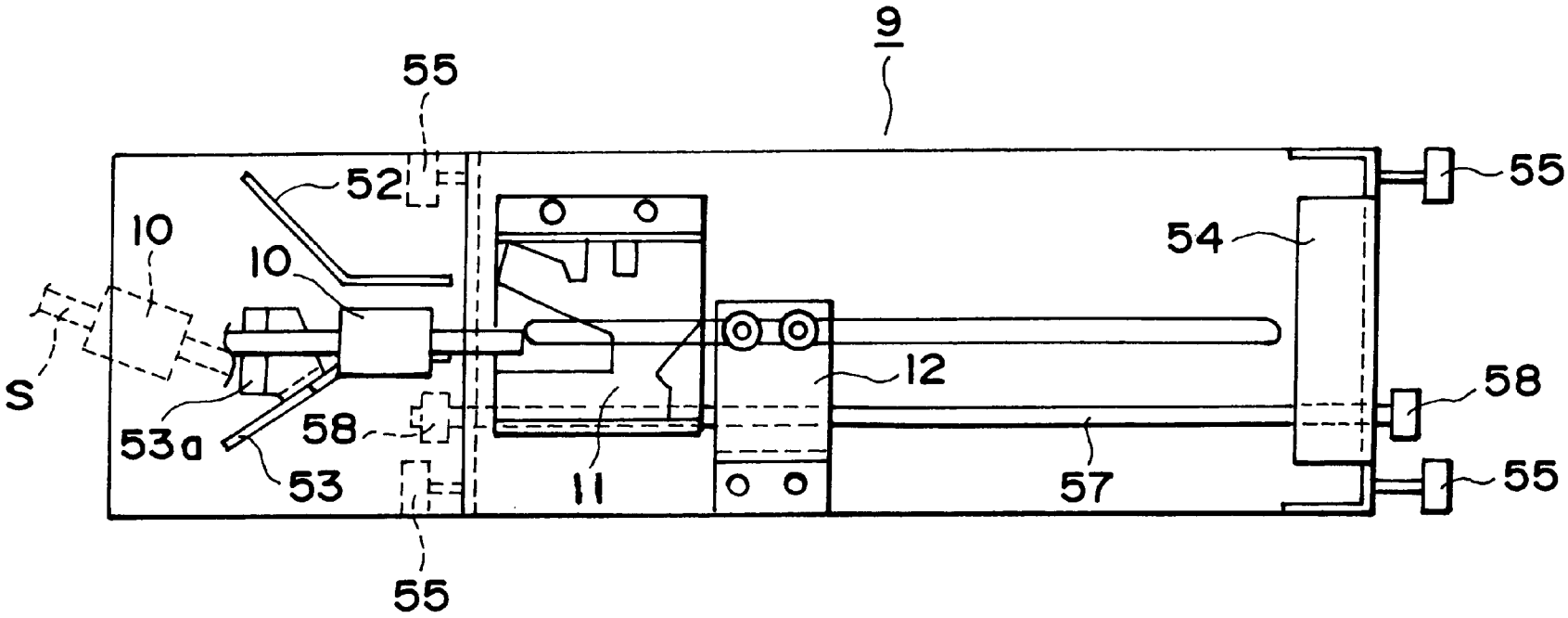
FIG. 8 is a side view of the same gripping-stapling unit.

Next, the gripping-stapling unit 9 will be described (FIGS. 7 and 8).

FIGS. 7 and 8 are a plan view and a front view, respectively, of the gripping-stapling unit 9.

As for its general structure, guide stay 53 and a right stay 54 are bridged between a front plate 50 and a rear plate 51, forming thereby the unit frame. To this frame, a total of four rollers 55, two on the left rear and two on the right rear, are attached by crimping. On the rear side of the bottom guide stay 53, a member 53*a* for guiding the sheet set when the sheet set is transferred is fixed.

The four rollers are guided by two rails fixed to the main frame of the apparatus. On each rail, a rack is cut across the length of the rail 56, and this rack meshes with a pinion gear 58 mounted at one end of a shaft 57 that penetrates across the frame. As the driving force is transmitted from the vertical movement motor M4 to the pinion gear 58, the whole frame is vertically moved.

There are three moving members within the frame. The tip advancing gripper 10 can be moved in the direction of an arrow D in FIG. 7. It grips the sheet set S, by a portion, which is located along the edge S1 on the front reference side, as close as possible to the stapler 11, and advances the sheet set S to the rightward direction.

A pre-advancement distance 14 between the right edge of the tip advancing gripper 10 and the leading end of the sheet set S is set to be slightly longer than a post-advancement distance 35 between the left edge of the stapler 11 and the leading end of the sheet set S.

Since the tip advancing gripper 10 transfers the sheet set by gripping the sheet by a position as close as possible to the stapler 11, the sheet alignment disturbance, which otherwise might occur within the sheet set when the sheet set is processed by the stapler 11, can be prevented, contributing to the further stabilization of the stapler 11 during a stapling operation.

Further, since the tip advancing gripper 10 grips the sheet set S only by the portion along the edge (S1 in this case) excluding the edge S2 (alignment reference side edge) which faces the stapler 11, the stapler 11 can be freely moved in the direction of an arrow mark E. In other words, the stapler can be moved to the retracting positions in front or in the rear, which are off the sheet set path, and to any position along the leading edge of the sheet set S, to process the sheet set S.

The transfer gripper 12 is movable in the direction of an arrow F in FIG. 7, and also, is movable together with the front and rear plates 59 and 60 in the direction of an arrow G. It is moved in the arrow F direction depending on the sheet size so that it grips the sheet set S by the edges S2 facing the stapler 11, that is, the edge having been butted against the aligning portion Bj of the upright portion of the bin, at a substantially middle portion in the width direction, and then, it pulls the sheet set completely away from the bin in order to transfer the sheet set S onto the stacker, which will be described later.

In other words, the transfer gripper 12 grips the sheet set S and transfers it in a manner to pull it by the edge portion on the downstream side in terms of the direction in which the sheet set S is advanced toward the stapler 11; therefore, the sheet set S can be transferred onto the stacking unit 13 without being buckled or skewed during the transfer.

Further, since the transfer gripper 12 transfers the sheet set S by gripping the substantial center portion of the sheet set regardless of the sheet size, the orientation of the sheet set S remains stabilized while it is transferred. As a result, even when the transfer gripper 12 is opened to release the sheet set S into the stacking unit 13, the sheet alignment disturbance can be minimized.

The movement of the gripper 12 in the arrow F direction is used not only for adjusting the gripping location depending on the sheet size, but also, for sorting the sheet sets on the stacker.

More specifically, when the sheet set is transferred onto the stacker, the distance the transfer gripper 12 is moved in the arrow G direction is dependent on the sheet size, but if at this time, the distance it is moved in the arrow F direction is varied, a plurality of sheet sets having the same size can be separated from each other, or a group of sheet sets belonging to one copying operation can be separated from other groups of sheet sets belonging to the other copying operation.

A length 16, that is, the gripper 12 measurement in the depth direction of the apparatus, is set to be such that even when the stapler 11 is at a position where the stapler works on the sheet set S, the gripper 12 can hang onto the leading end of the sheet set S.

Below, the moving members 10, 11 and 12 in the gripping-stapling unit 9 will be described in detail.

Figure 9:
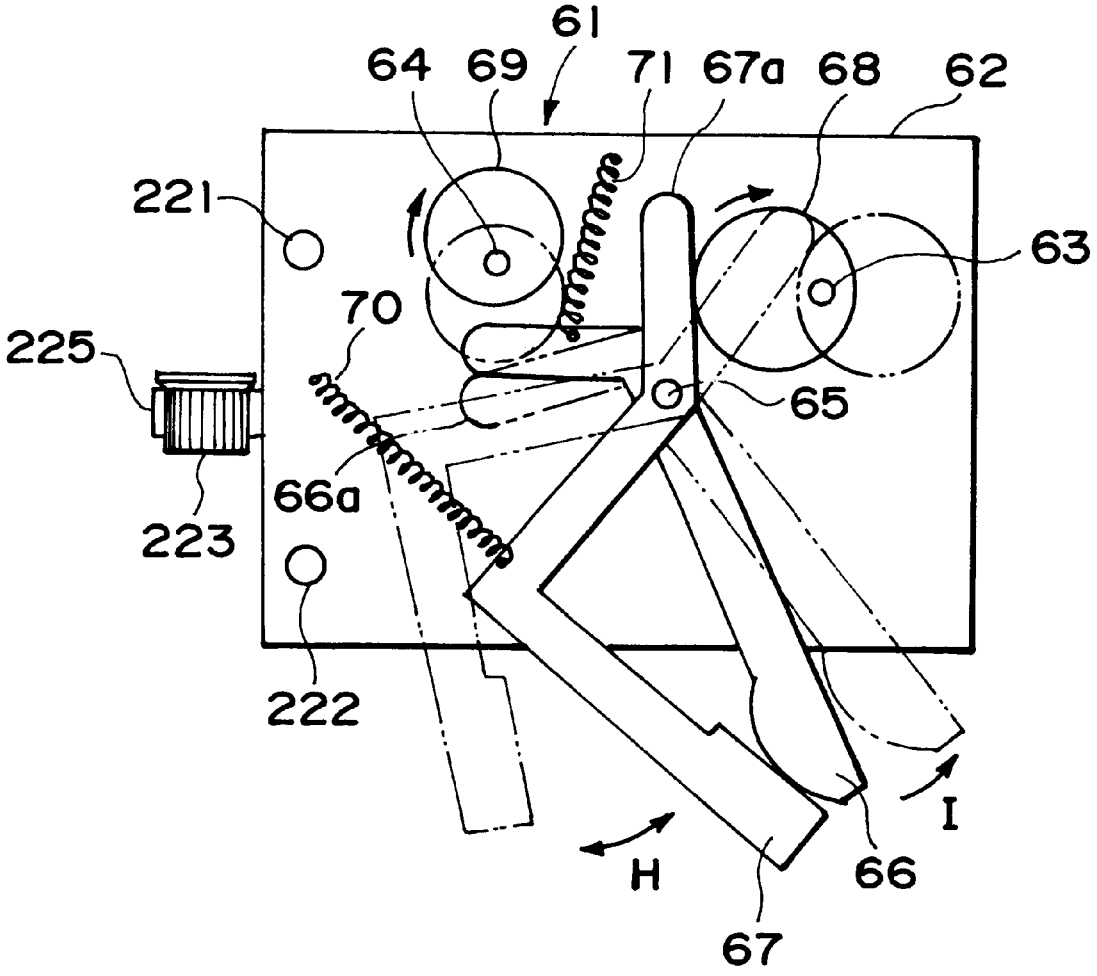
FIG. 9 is a side view of the gripper portion.

First, the portion that grips the sheet set will be described The structure of the gripping portion is common for the tip advancing gripper 10 and transfer gripper 12 (FIG. 9).

Three axes 63, 64 and 65 are supported on the side plates 62 and 62. Both of the top and bottom pieces 66 and 67 of the gripper are mounted on the axis 65. When a bottom piece cam 68 fixed to the axis 63 and a top piece cam 69 fixed to the axis 64 are rotated in the direction of arrows, the bottom and top pieces are oscillated in the directions of arrows H and I, respectively (solid line and broken line).

A spring member 70 pulls the cam portion 67*a* of the bottom piece 67 toward the bottom piece cam 68, and a spring member 71 pulls the cam portion 66*a* of the top piece 66 toward the top piece cam 69, wherein the contact pressure between the top and bottom pieces of the gripper is controlled to remain substantially constant. The top and bottom piece cams are driven by unillustrated motors M5 (tip advancing gripper) and M6 (transfer gripper).

As described above, the basic structure is the same for the tip advancing gripper 10 and transfer gripper 12, wherein gripper characteristics such as the gripping pressure, gripper width, maximum opening distance or the like may be optimally selected according to the conditions under which the apparatus is used. For example, in this embodiment, the tip advancing gripper is given a small width because of the available space and because it grips only the reference side; therefore, the gripping pressure is increased to prevent the shifting of the sheet sets, and the maximum opening distance is kept on the smaller side to allow the gripper to advance into the bin intervals. On the other hand, the transfer gripper can grip the center portion of the sheet set; therefore, the gripping pressure may be set to be relatively low.

Figure 10:
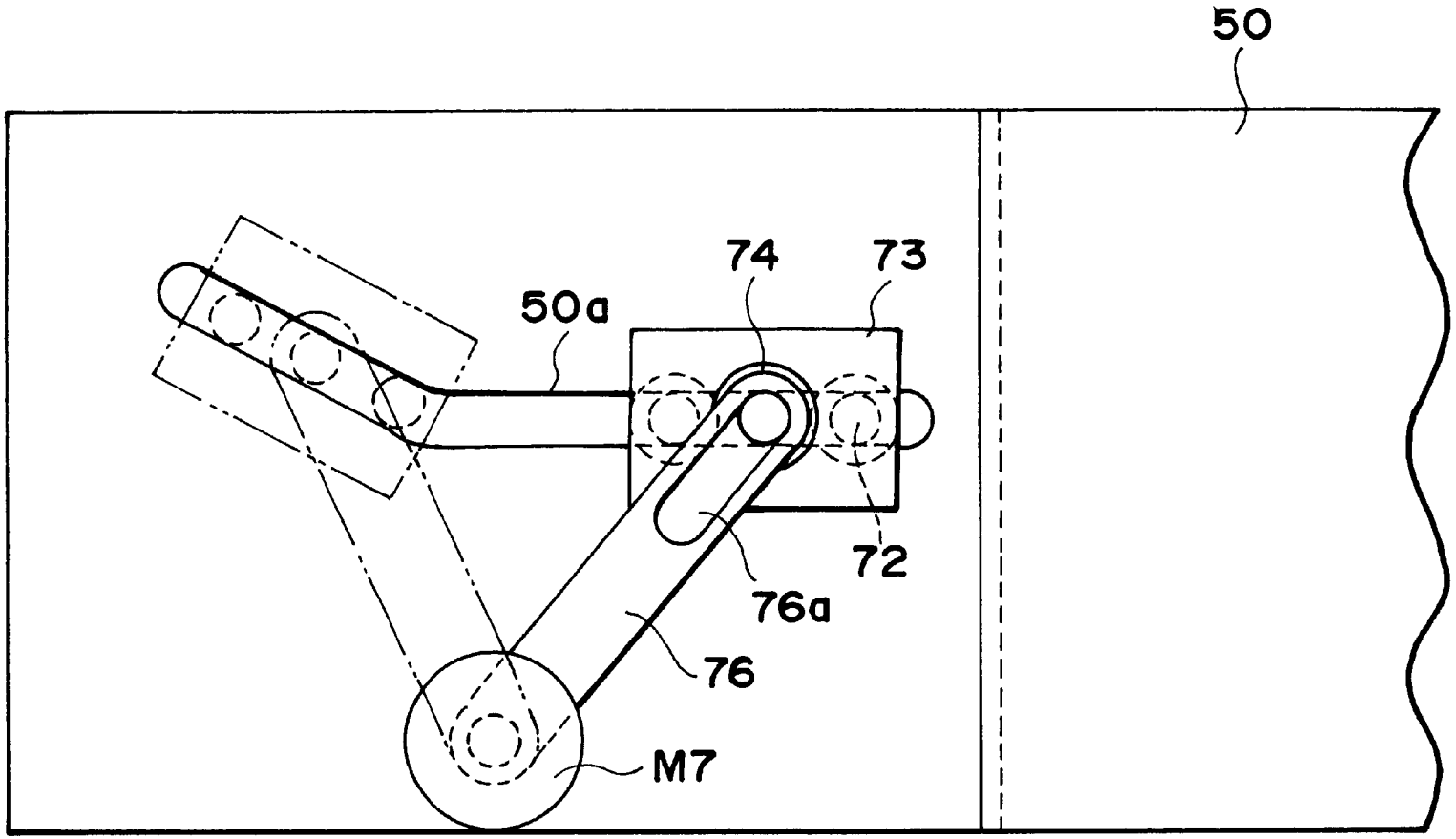
FIG. 10 is a side view of the tip advancing portion of the gripper driving section.

Next, the driving mechanism for the tip advancing gripper 10 will be described referring to FIG. 10, a front view.

On the front side of the tip advancing gripper, a grooved roller 72 is fixed by crimping, and this roller is fitted in an elongated hole 50*a* cut in the front plate 50 of the gripping-stapling unit. Referring to FIG. 10, the elongated hole 50*a* is cut substantially horizontally on the right-hand side, but. on the left-hand side, it is given an angle parallel to the bin angle. Two rollers are connected to each other at the end portion of the axis, with a connecting plate 73, and on the connecting plate 73, a bin member 74 Is attached.

On the front surface of the front plate 50, a tip advancing motor M7 is mounted, and its power shaft is connected to an oscillating arm 76. The other end of the oscillating arm has an elongated hole 76*a*, in which the end portion of the aforementioned bin member 74 is fitted. When the tip advancing motor M7 is driven, the oscillating arm 76 oscillates between a solid line position and a double dot chain line position in FIG. 10. With this arrangement in place, the tip advancing gripper is moved along the elongated hole of the front plate 50, wherein it grips the sheet set at a position in the slanted range, carries it to a position in the horizontal range, releases it there, and returns to the position in the slanted range.

Figure 11:
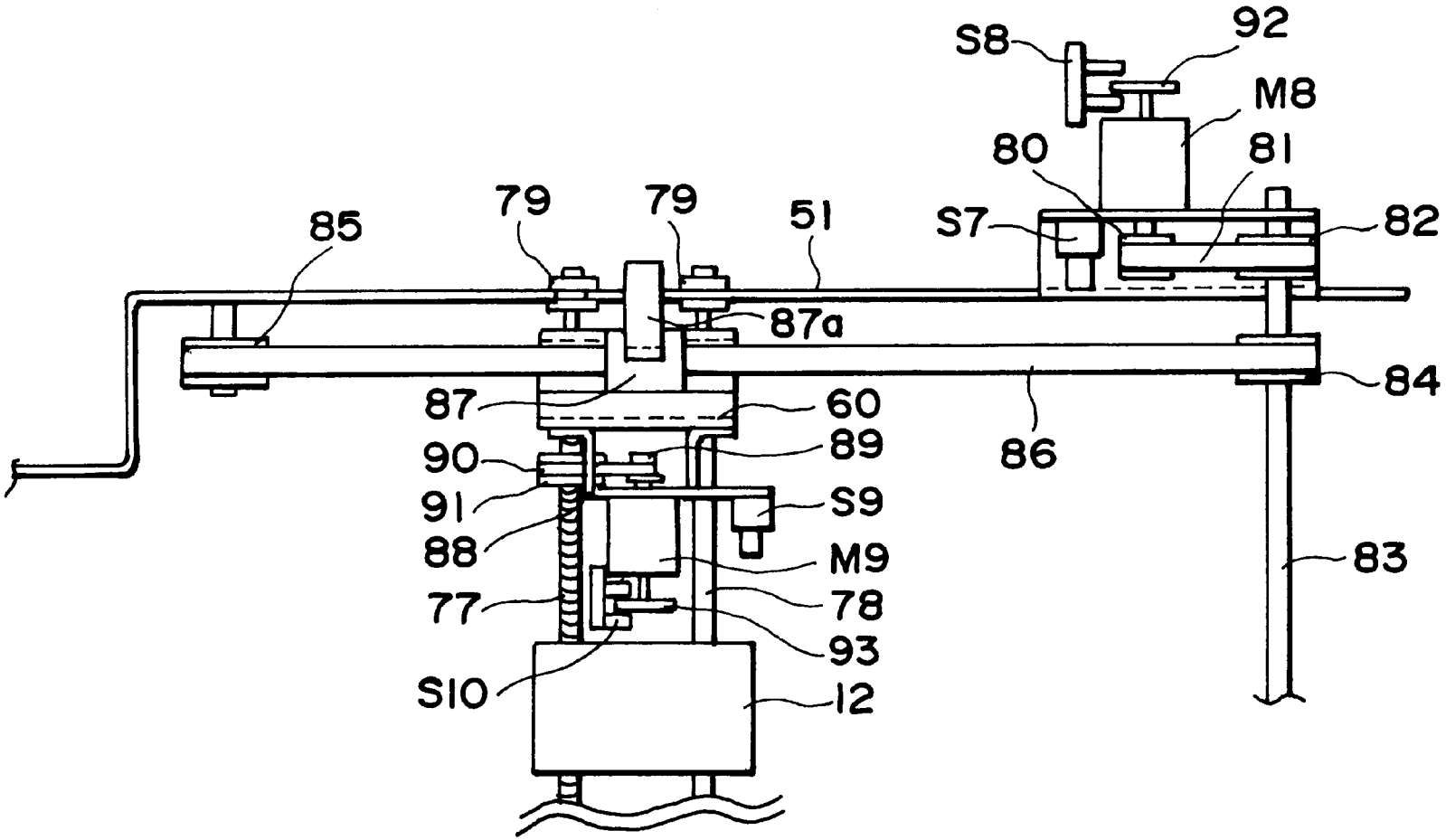
FIG. 11 is a plan view of the conveyer gripper driving section.
Figure 12:
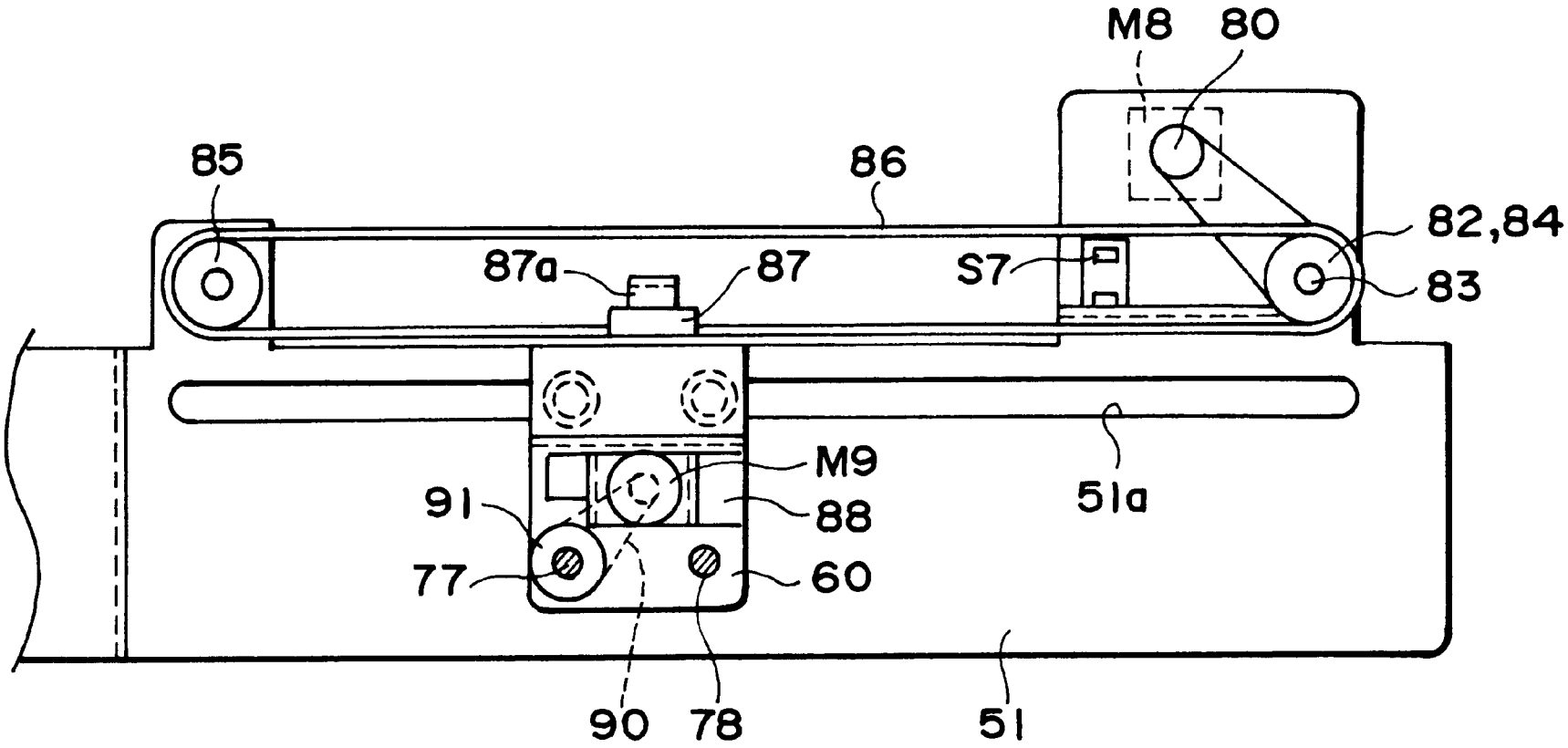
FIG. 12 is a side view of the conveyer gripper driving section.

Next, the driving mechanism of the transfer gripper 12 will be described referring to FIG. 11, a plan view, and FIG. 12, a sectional front view.

First, it will be described how the sheet set transfer gripper is driven in the transferring direction, that is, in the lateral direction of FIG. 11.

The transferring gripper 12 is supported by two axes 77 and 78 from underneath. The axis 77 is in the form of a ball screw, and the axis 78 is in the form of a plain axis. They are supported between the front plate (unillustrated) and the rear plate 60), wherein the axis 77 is supported at each end by a bearing, and the axis 78 is fixed at each end. On each side plate, a guide roller 79 is attached by crimping. It is allowed to move laterally following an elongated hole 51*a* cut in the side plate 51.

A motor M8 for moving laterally the transfer gripper is mounted on the side plate 51, and transmits the driving force to a through axis 83 by way of a motor pulley 80, a belt 81 and a pulley 82. On the through axis 83, driving pulleys 84 are mounted, one in front and one in the rear, and belts 86 are stretched between the driving pulleys 84 and correspondent follower pulleys 85. A portion of the belt is fixed to a rear plate 60 using a regulating member 87, whereby the driving force from the motor M8 is transmitted to the transfer gripper 12 so as to move laterally the gripper 12.

Next, it will be described how to drive the transfer gripper 12 in the direction perpendicular to the sheet set transferring direction, that is, in the vertical direction of FIG. 12.

On the rear plate 60, a motor M9 for moving the transfer gripper 12 in the frontward-rearward direction is attached using a base 88. The driving force from the motor M9 is transmitted to a ball screw axis 77 through a motor pulley 89, a belt 90, and pulley 91. A thread correspondent to the thread of the ball screw axis 77 is cut in the transfer gripper 12 on the surface where the gripper 12 makes contact with the ball screw axis 77; therefore, the transfer gripper 12 can be moved frontward or rearward by the rotation of the ball screw axis 77.

The location of the transfer gripper 12 is determined by detecting its home position and the amount of the motor revolution. As for the location in the lateral direction, a projection 87*a* projecting upward from the regulating member 87 is detected by a home position sensor S7, and the distance the transfer gripper moves is detected by a sensor S8 that reads the encoder of the motor M8, whereby the gripper 12 is stopped at a predetermined location. As for the location in the frontward-rearward direction, a portion of the transfer gripper 12 is detected by the home position sensor S9, and the moving distance is detected by a sensor S10 that reads the encoder 93 of M9, whereby the gripper 12 is stopped at a predetermined location.

Next, the structure of the stacking unit 13 will be described with reference to FIG. 15, a plan view, FIG. 17, a front view of the frame portion of the stacking unit, and FIG. 18, a left side view.

Figure 15:
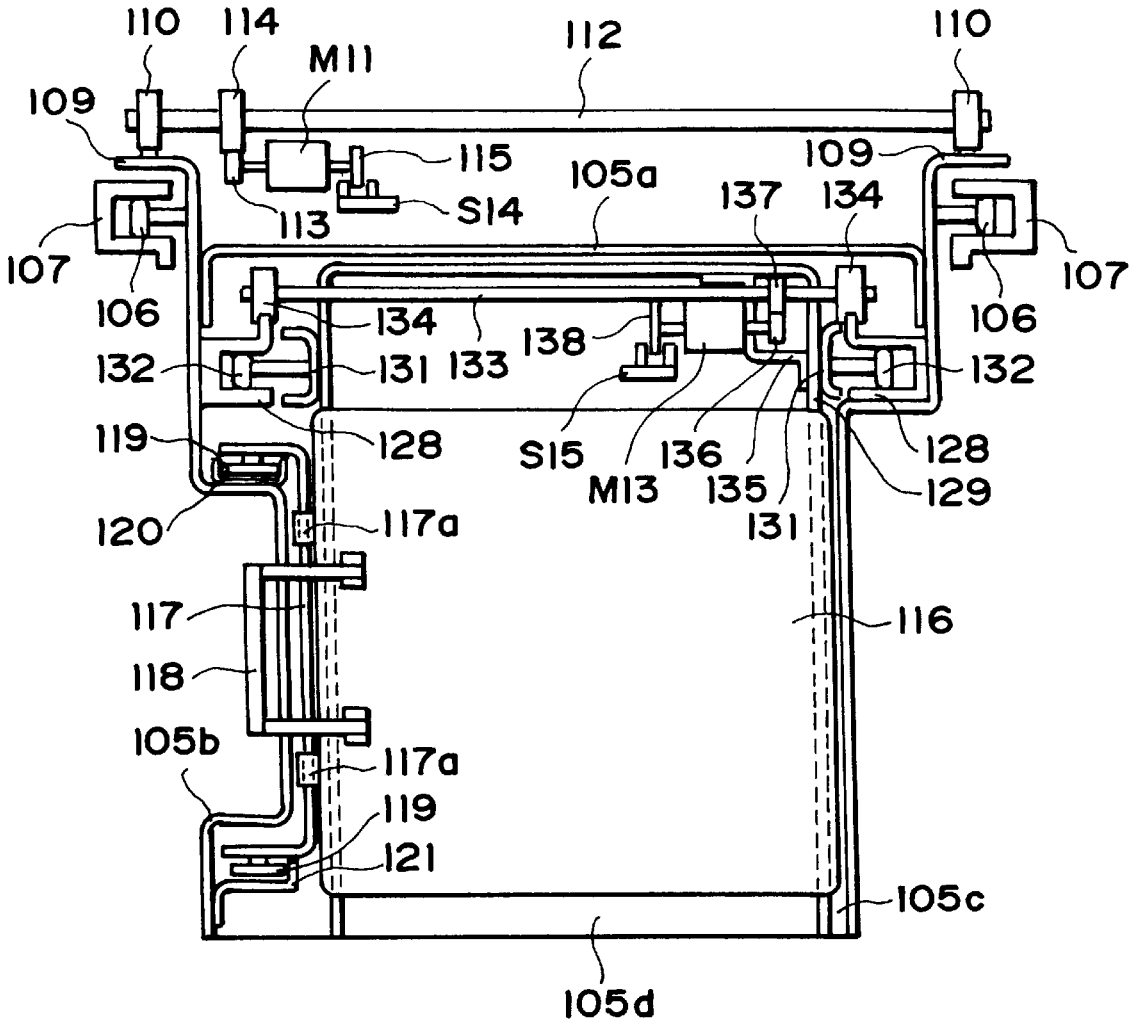
FIG. 15 is a plan view of the stacking unit.

First, referring to FIG. 15, a frame 105, which serves as the outer frame of the stacking unit 13, is constituted of four sections: a rear plate 105*a*, a left plate 105*b*, a right plate 105*c*, and a bottom plate 105*d*. On the exterior surface of the left plate 105*b* and that of the right plate 105*c*, two rollers 106 for vertical movement are attached (total of four rollers), on the rear side, and these rollers 106 are guided by a rail 107 fixed to the main frame of the apparatus. It should be noted here that this rail 107 may be the very rail 56 of the gripping-stapling unit 9 illustrated in FIG. 7; in other words, the same rail may be shared by the stacking unit 13 and gripping-stapling unit 9.

Figure 18:
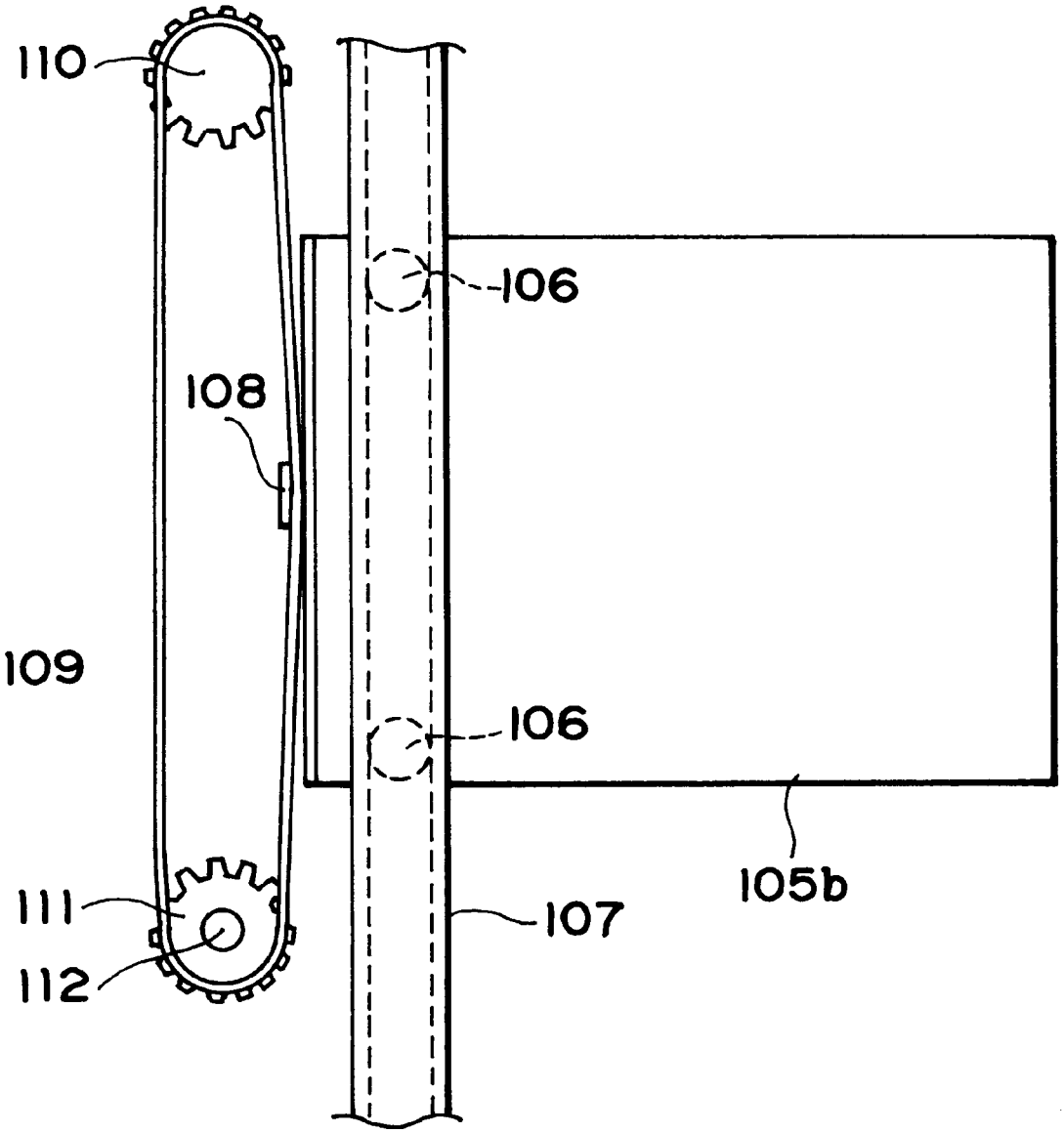
FIG. 18 is a side view of the stacking tray driving section.

In FIGS. 15 and 18, at the rear, a chain 109 is fixed to the bent portion of the left plate 105*b* and another chain 109 is fixed to the bent portion of the right plate 105*c*, wherein the left and right chains are stretched between correspondent top and bottom sprockets 110 and 111. The bottom sprockets are connected with a through axis 112, wherein a motor M11 for moving vertically the stacker frame is mounted on the main frame of the apparatus, and the driving force from the motor M11 is transmitted to the through axis 112 by way of gears 113 and 114, whereby the stacking unit frame 105 can be vertically moved.

As for the locations where the frame is stopped, in addition to two locations correspondent to two stopping locations of the gripping-stapling unit 9 illustrated in FIG. 2 (broken line above, and solid line below), more locations are set, for example, a location at which the stacker tray can be pulled out, which will be described later, a location at which the stacking unit is stopped to change the limit the stacking height limit, and the like locations. Normally, the home position of the stacking unit is the position correspondent to the top bin module. Returning to FIG. 15, the stacking unit 13 can be stopped at the aforementioned various locations by reading the encoder 115 of the motor M11 with the use of sensor S14.

On the left plate 105*b* of the stacker frame, there is a stacking reference wall 117, which serves as a reference wall for the sheet sets on the stacking tray 116, and is supported so as to be moved vertically, and also, a pressing member 118 is supported, which holds down the sheet sets on the stacking tray 116 from above.

Normally, the stacking reference wall 117 is positioned at the bottommost level, and is moved upward when the stacking height limit is changed, which will be described later.

As for the mechanism for moving vertically the stacking frame, referring to FIG. 15, a total of four rollers 119, two in front and two in the rear, are mounted on the reference wall, and these rollers 119 are guided by correspondent rails 120 and 121 fixed to the left plate 105*b* of the stacker frame, making it possible to move vertically the reference wall. The driving force comes from an unillustrated motor M12 for moving vertically the reference wall. Also referring to FIGS. 15 and 17, a guide roller 117*a* is rotatively attached to the reference wall 117 so that the trailing end of the sheet set is prevented from becoming stuck on the slanted surface 117*b* formed at the top portion of the reference wall 117.

Further, a proximity sensor S16 is provided on the top end of the reference wall, which detects the distance between the stacking unit and the gripping-stapling unit above, so that when two units approach closer than a predetermined distance, the driving force in the approaching direction is stopped to avoid collision. Further, on the lateral surface of the reference wall, a stack height sensor S17 is mounted, which detects the topmost sheet of the accumulated sheet sets to control the vertical position of the stacking tray 116 or the like.

Figure 16:
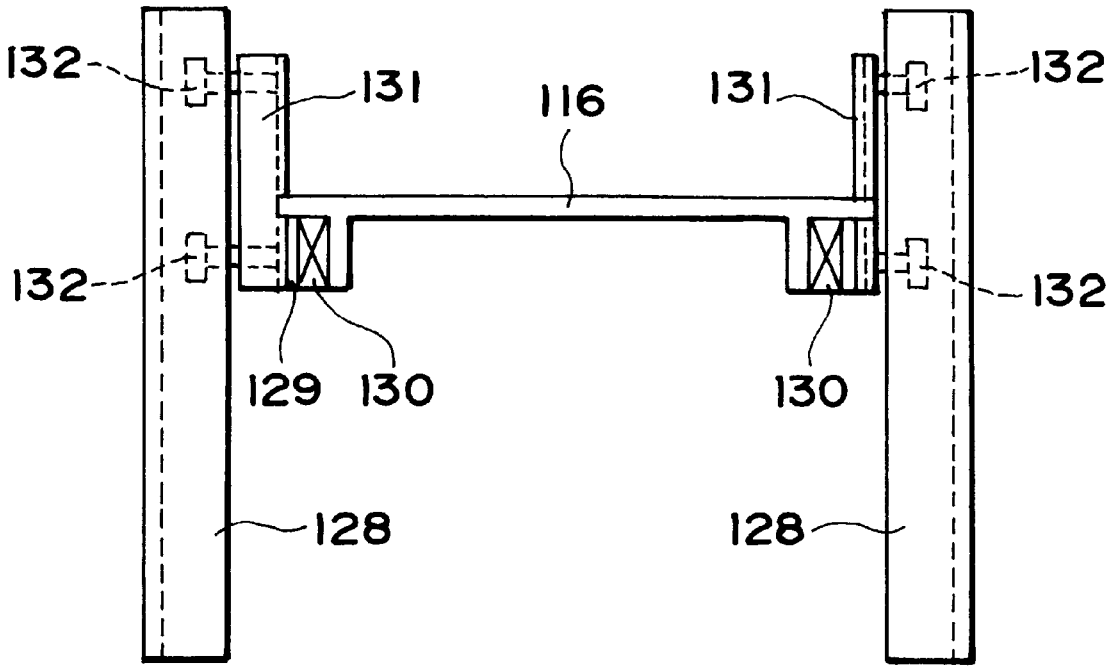
FIG. 16 is a plan view of a stacking tray.

Next, the stacking tray 116 will be described referring to FIGS. 15 and 16.

The stacking tray 116 is fitted within the aforementioned stacker frame 105, and is controlled to descend gradually so that the uppermost surface of the sheet set stack remains at a predetermined level.

Referring to FIGS. 15, reference numerals 128 and 128 designate rails, which are fixed to correspondent side plates. The stacking tray 116 rests oh a guide rail 130, and can be pulled out of a stacker tray base 129 toward the front. On the outward facing left and right surfaces of the stacking tray base 129, a U-shaped roller mounting plate 131 is attached, to which two rollers 132 are mounted by crimping. These rollers 132 are guided by the rail 128. At one and of the rail 128, a vertical rack is provided, which meshes with a pinion gear 134 mounted at each end of an axis 133, which is horizontally put through the base 129. A motor M13 for moving vertically the stacking tray is mounted on the stacking tray base 129 with the use of a motor mount 135, and the driving force from the motor M13 is transmitted through gears 136 and 137. The descending amount of the stacking tray is controlled by reading an encoder 138 attached to the other end of the motor M13, with the use of sensor S15.

Figure 20:
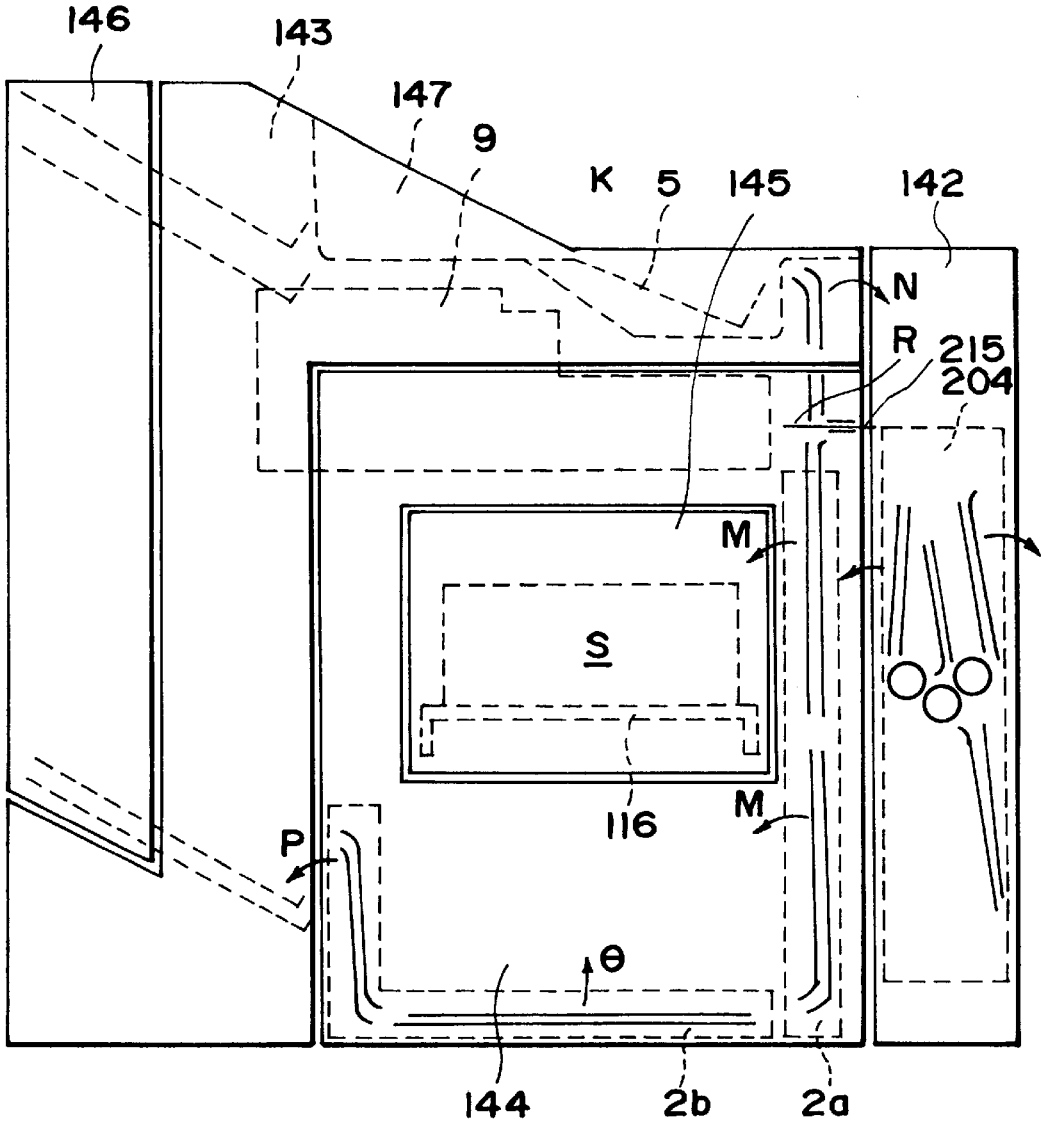
FIG. 20 is a phantom drawing of the cover portion of the sheet processing apparatus.

FIG. 20 illustrates the cover structure, and reference numerals 142–146 all designate a cover.

Below, the operations of the sheet processing apparatus will be described with reference to the structure described hereinbefore. To begin with, the basic operation will be described.

First, a set of originals is placed on the original table 105 of the automatic original feeding apparatus 202 joined with the main assembly 201 of a copying machine (FIG. 1), and after a predetermined copying mode selection is inputted through an unillustrated control panel, a start key is depressed, whereby various sections of the sheet processing apparatus 203 are brought to a state of being on standby in response to the signal generated as the start key is depressed. Hereinafter, the description will be given in correspondence with the mode selections.

Non-sort Mode

Figure 19:
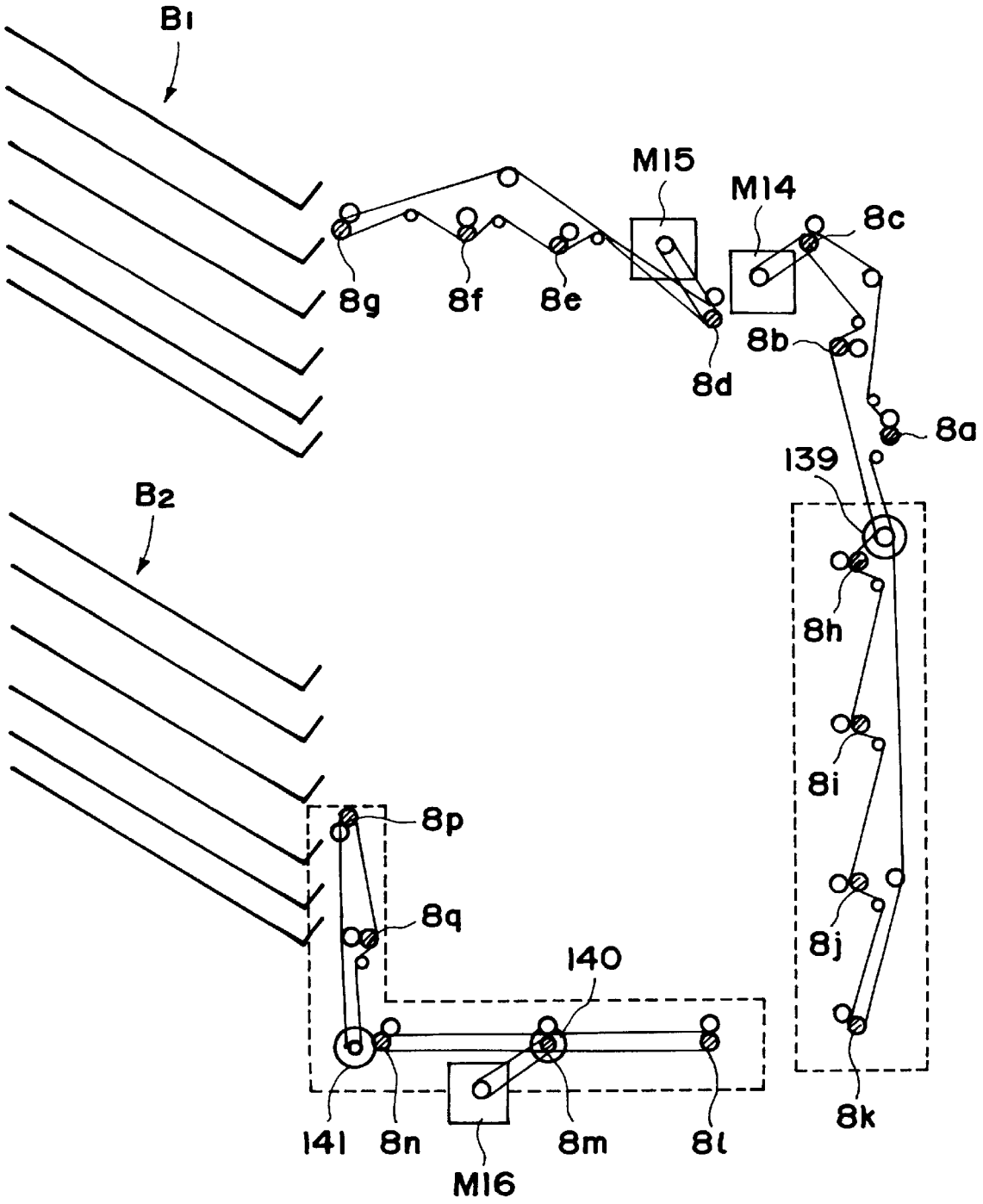
FIG. 19 is a schematic section of the conveyer system.

Referring to FIG. 2, the deflectors 3 and 4 are oriented as outlined by the solid and broken line, respectively, and the motor M14 is controlled so as to rotate the roller pairs 8*a*, 8*b* and 8*c* distributed across the sheet discharge path 6 (FIG. 19).

The sheet, which is discharged from the copying machine main assembly 201 after an image is formed thereon, passes through the top path of the folding apparatus 204 and advances into the stapling-stacking apparatus 205 through the sheet entrance 215, where the sheet is directed straight upward by the deflector 3. Then, it is delivered further upward on the right-hand side of the deflector 4, and is discharged into the non-sort tray by the discharge roller pair 8*c*.

Sort Mode

Next, a general operation carried out in the sort mode will be described.

First, during the standby operation, both deflectors 3 and 4 are oriented as outlined by the solid line, and the top and bottom bin modules B1 and B2 are shifted so that the topmost bins B11 and B12 come to the locations where they face the discharge roller pairs 8*g* and 8*p*, respectively. The aligning wall 15 of the bin module is moved to a position correspondent to the sheet width and remains there on standby.

The upright portion of the bin is not activated.

The gripping-stapling unit 9 is moved to a position (outline by the broken line in FIG. 2) correspondent to the sheet set transfer from the top bin module, and is kept there on standby.

Referring to FIG. 7, the moving members within the gripping-stapling unit 9 will be described.

The gripper 10 remains on standby at a location indicated in FIG. 7 so that it does not interfere with the sheet on the bin when the bin module located on the left-hand side of the gripping-stapling unit 9 is vertically moved.

Since the stapler 11 is not operated, it is moved to the retracted position on the front side outlined by the broken line in FIG. 7.

The transfer gripper 12 is moved in the arrow mark F direction as well as arrow mark G direction to a position 12*a* outlined by the broken line in FIG. 7, where it can grip the delivered sheet at the substantially middle portion of the sheet edge advanced by the sheet tip advancing gripper 10, and is kept there on standby.

While on standby, both the tip advancing gripper 10 and transfer gripper 12 are open.

Next, the stacking unit 13 is moved to a position outlined by the broken line in FIG. 2, being prepared for receiving the sheet set to be delivered from the gripping-stapling unit 9.

Figure 17:
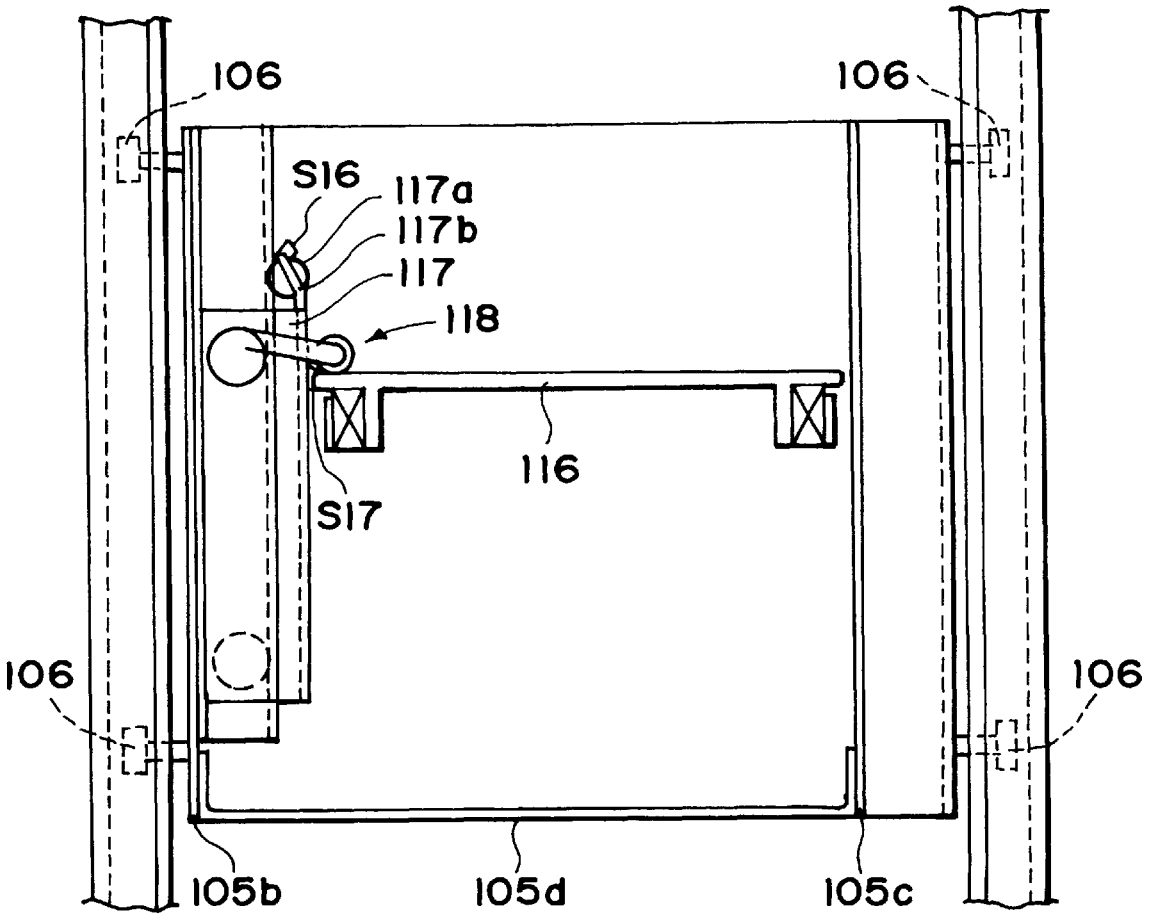
FIG. 17 is a front view of the stacking tray.

Referring to FIG. 17, the stacking tray 116, reference wall 117, or pressing member 28 within the stacking unit 13 is moved to a position where it allows the top surface of the stacking tray 116 to receive the sheet sets without interference, and the other members are also moved to respective positions to accommodate the stacking tray. The pressing end of the pressing member 118 projects on the stacking tray 116 side as illustrated in FIG. 17.

The discharged sheet is passed through the top path P1 of the folding apparatus; delivered into the sheet processing apparatus through the sheet entrance 215; directed upward by the deflector 3; directed leftward by the deflector 4; and discharged onto the bin B11 by the discharge roller pair 8*g*.

After the sheet is discharged on the bin B11, the bin module is shifted upward by one bin, so that the bin B12 moves up to the sheet receiving position. This step is repeated for each sheet to discharge the sheet into the bins in the top bin module. At this moment, the top bin module is positioned in such a manner that its bottommost bin (B16 in FIG. 2) is at the sheet receiving position; therefore, when the second sheet of the original is copied, the copy is discharged into the top bin module starting from the bottommost bin, continuing upward.

These steps are repeated until all the sheets of the original are copied, and then, the sheet reception into the top bin module ends. After the completion of the sheet delivery, the sheet set transfer operation is started.

Referring to FIG. 8, the sheet set tip advancing gripper 10 is moved, with the gripping portion open, from the solid line position to the broken line position, where it is caused to grip the sheet set S on the bin. Next, referring to FIG. 6, the upright portion Bj of the bin is released by the solenoid SL1 to allow the sheet set to be transferred.

Next, the sheet set is advanced rightward to a position outlined by a solid line in FIG. 8 while being regulated by the reference rods 14*a* and 14*b* and aligning wall 15, on the front and rear sides, respectively, as shown in FIG. 4, and also, by a guide member 53*b* on the rear side as shown in FIG. 7. Then, the sheet set is temporarily stopped at the solid line position, where it is relayed from the tip advancing gripper 10 to the transfer gripper 12, in the following manner.

First, the transfer gripper 12, which has been on standby, with its jaw open, at a position outlined by the broken line in FIG. 7, grips the sheet set at the substantially center portion of the advanced sheet set edge. Next, the tip advancing gripper 10 is caused to loosen its grip, being thereby readied for advancing the next sheet set. Thereafter, the transfer gripper 12 is moved to the right in the arrow mark G direction in FIG. 7, pulling the sheet set to the right, and is stopped at a proper position for the sheet size.

Figure 21:
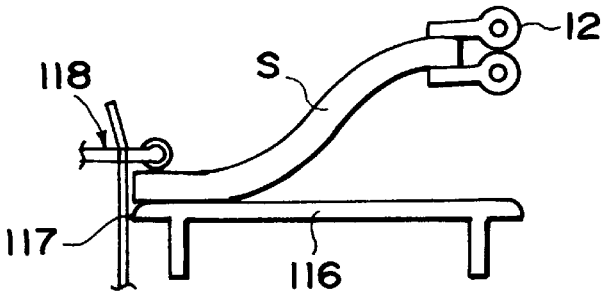
FIG. 21 is a schematic side view of the stack pressing member, describing the effects thereof.

At this moment, referring to FIG. 21, the trailing end of the sheet set S has fallen to the top surface of the stacking tray 116, with the left edge being regulated by the reference wall 117 of the stacking unit, and the top surface being held down by the pressing member 118 having been driven by the solenoid. Then, the transfer gripper 12 is released to allow the leading end of the sheet set S to fall to the stacking tray.

At this time, the pressing member 118 functions to prevent the sheets within the falling sheet set from shifting.

Next, as for the transfer of the second sheet set, it is the same as the transfer of the first one up to the point where the sheet set is gripped by the transfer gripper 12 at the substantially middle portion of the sheet set edge to be relayed between the grippers; therefore, only the steps thereafter will be described. After the sheet set is relayed, the transfer gripper 12 is moved in the arrow mark F direction by a predetermined distance. This movement makes it possible to separate the second sheet set from the first one after it is transferred onto the stacking tray.

The topmost surface of the stack of the sheet sets deposited on the stacking tray is constantly monitored by the sensor, and in response to the signal from the sensor, the stacking tray is gradually lowered so that the interval between the gripping-stapling unit above and the topmost surface of the stacked sheet sets remains constant.

The sheet sets on the stacking tray can be taken out any time except for the time when the stacking unit is operating. As an operator presses an unillustrated sheet set removal button, the stacking unit moves to a sheet set removal position, and only the stack removal cover becomes openable.

After the sheet sets are taken out and the cover is closed, the sheet processing operation can be continued.

Stapling Mode

As far as the sheet or sheet set movement is concerned, this mode is the same as the sorting mode; therefore, its description will be omitted here, and only the stapler movement control will be described.

Figure 13:
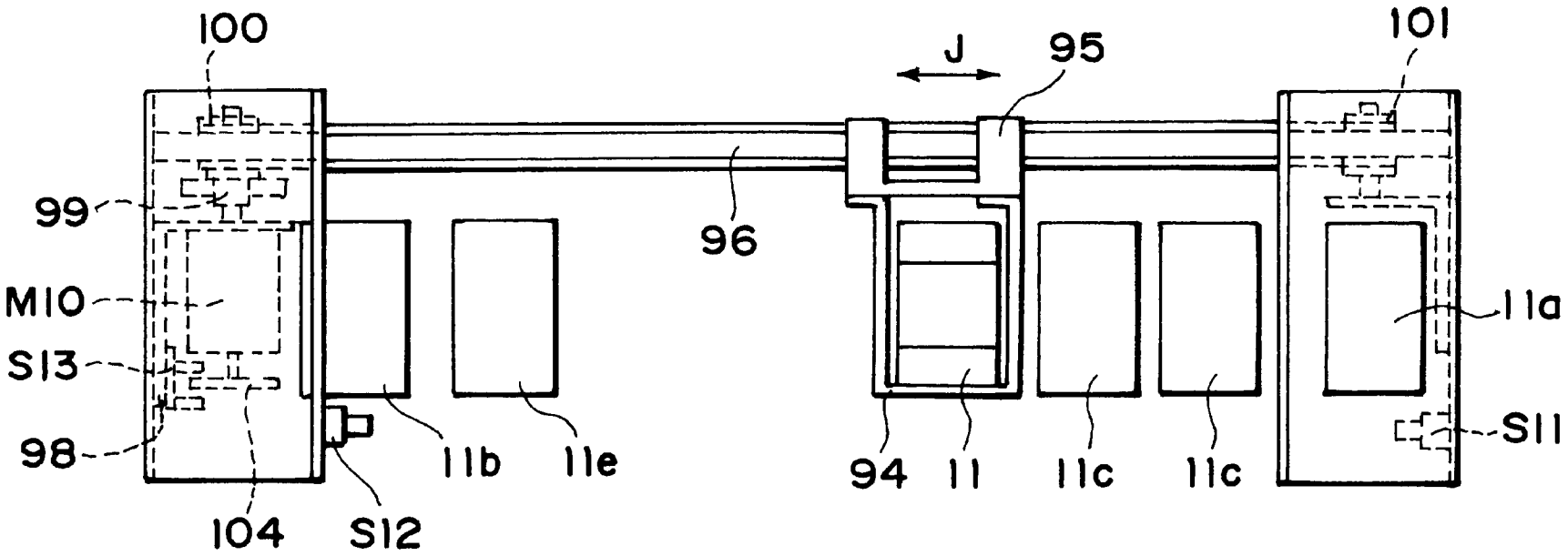
FIG. 13 is a side view of the stapling unit driving section as seen from the left side of FIG. 7.
Figure 14:
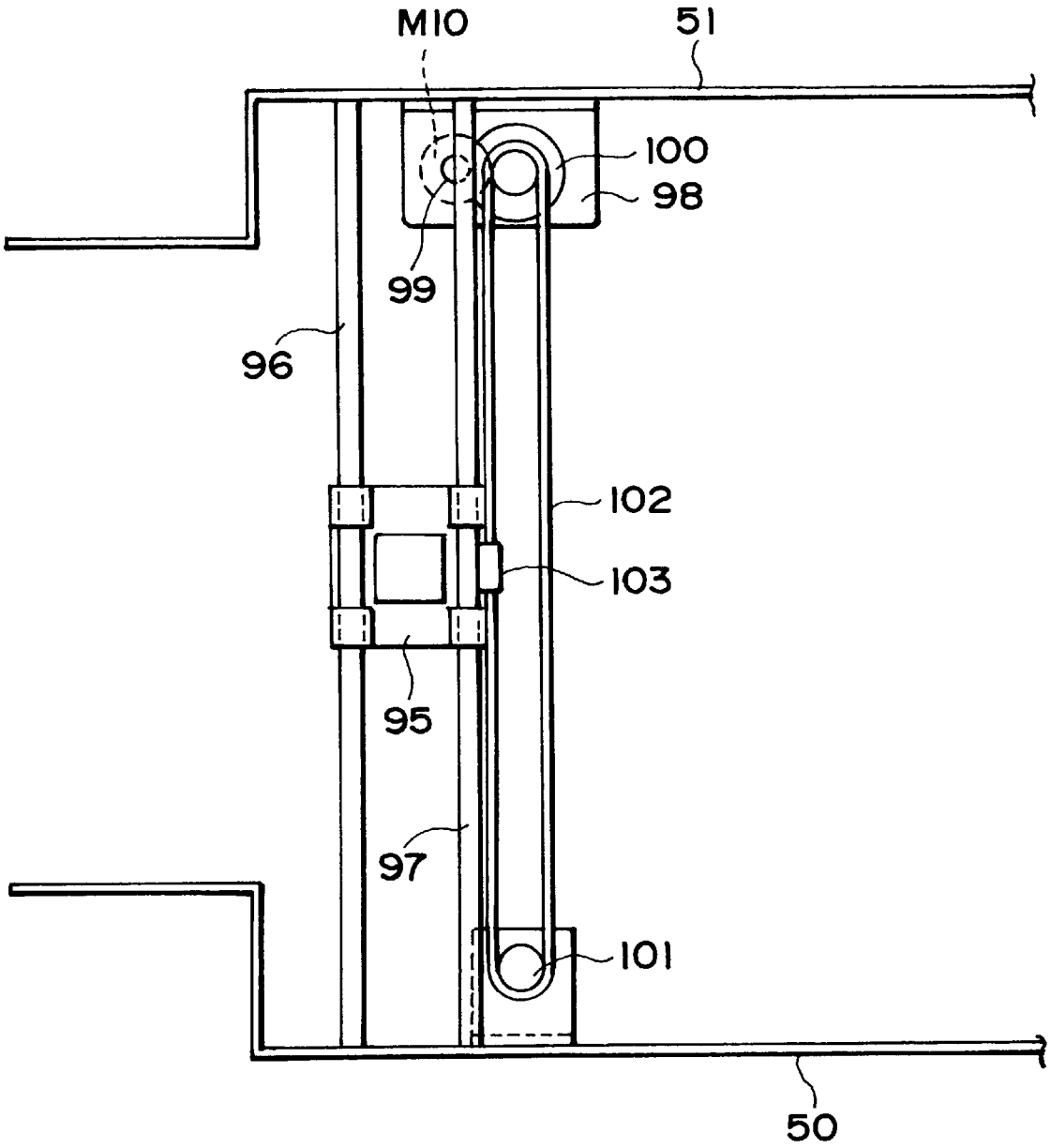
FIG. 14 is a plan view of the same stapling unit driving section.

Referring to FIGS. 7 and 13, the stapler 11 can be stopped at any location between the front side retracted position 11*a* and rear side retracted position 11*b*.

Single Point Binding on Front Side

In the non-stapling modes described above, the stapler 11 is at the front side retracted position 11*a*, but when the single point front side binding mode is selected, the stapler 11 remains on standby at a position 11*c* indicated in FIGS. 7 and 13.

Even when the stapler 11 is on standby at a position 11C indicated in FIG. 7, it and the transfer gripper 12 can remain on standby without interfering with each other, since the transfer gripper 12 is at a position 12*a*. After stapling the sheet set advanced by the tip advancing gripper 10, the stapler 11 is moved to the front side retracted position 11*a*, and then, the sheet set is conveyed to the right by the transfer gripper 12.

After the trailing end of the sheet set clears the moving range of the stapler 11, the stapler 11 moves back to the single point front binding position 11C and waits for the next sheet set.

Two Point Binding

Also in this case, the stapler 11 does not interfere with the transfer gripper position 12*a* whichever of the positions 11*d* and 11*e* indicated in FIG. 7 the stapler 11 may be at. As the two point binding mode is selected, the stapler 11 is moved from the front side retracted position 11*a* to the front side binding point 11*d* and is kept there on standby.

After being advanced by the sheet edge advancing gripper, the sheet set is stapled on the front side binding point by the stapler 11 at the front side stapling position 11*d*. At this time, the advanced sheet edge is still held by the edge advancing gripper. Then, the stapler 11 is moved to the position 11*e*, and the sheet set is stapled at the second binding point, that is, the point on the rear side. Next, as soon as the stapler 11 is moved from the position 11*d* to the position 11*e*, the transfer gripper 12 is advanced from the standby position 12*b* to the position 12*a* and grips the sheet set.

At this moment, on the other hand, the edge advancing gripper 10 releases the sheet set.

After stapling the sheet set on the second binding point at the stapling position 11*e*, the stapler 11 is moved to the rear side retracted position 11*b*. Then, as soon as the trailing end of the first sheet set clears the moving range of the stapler 11, the stapler 11 is moved from the retracted position 11*b* to the stapling position 11*e* on the rear side, and receives the second sheet set.

Single Point Rear Binding Mode

In this mode, the sheet set is bound on the rear side relative to the sheet edge center in the direction perpendicular to the sheet delivery direction; therefore, the movement of the stapler is opposite to the one in the mode <Single Point Front Binding Mode>. In other words, the stapler 11 shuttles between the rear side retracting position and the stapling position.

Folding Mode

In the folding mode, a relatively long sheet in the sheet delivery direction is subjected to a folding operation in the folding apparatus 204 illustrated in FIG. 2. Thereafter, it is processed in the same manner as a regular size sheet. In other words it is discharged into the bin; processed according to a selected mode; and deposited in the stacking unit 13. However, there is more than one way to fold a sheet: a so-called Z fold, which has a folded edge at the central portion of the sheet in the sheet delivery direction and on the slightly down stream side of the central portion; a C fold for folding a sheet of an overseas size LGL into the LTR size; or the like folds. In the case of these folds, it is liable that the leading edge of a folded sheet being discharged collides with, and/or slides in below, the folded edge of another sheet having been deposited on the bin, and as a result, the alignment of the sheets having been deposited is disturbed, and/or the folded sheet being discharged is not deposited in a proper manner.

Therefore, the uppermost bin is lowered below the normal sheet receiving position, and the sheet is accumulated only in the uppermost bin.

Operation Involving Plurality of Bin Modules

Next, the operation involving a plurality of bin modules (two modules in this embodiment) will be described. This operation can improve to the highest limit the overall operational efficiency of the system including the post-image formation processing while maintaining the productivity of the copying machine main assembly 201.

When the number of the copy sets to be made is no more than the number of the bins in a bin module (six in the aforementioned embodiment), the sheet processing operation is carried out as described hereinbefore, but when it exceeds the number of the bins, two bin modules are alternately activated.

Referring to FIG. 2, at first, a first group of sheet sets is sorted using the top bin module B1, wherein the number of sheet sets in this group is the same as the number of the bins, that is, six in this embodiment. Next, while the gripping-stapling unit 9 at the broken line position transfers the sheet set from each bin of the top bin module to the stacking unit 13, the sheets are sorted into the bottom bin module B2. After the sorting for the bottom bin module is completed, the sheet set is moved out of each bin of the bottom bin module by the gripping-stapling unit and stacking unit 13 having been moved to the solid line position by this time. Meanwhile, the top bin module becomes empty as the sheet set is removed; therefore, as soon as the sorting for the bottom bin module is completed, the sheets can be sorted again into the top bin module, allowing the sorting operation to be continued without interruption.

With this arrangement, the sheets discharged from the copying machine main assembly are deposited into either the top or bottom bin module without interruption. Therefore, it is unnecessary to stop the copying operation of the copying machine main assembly while carrying out the sheet processing operation such as the removal of the sheet set from the bin, stapling of the sheet set, or the like. In other words, the entire process can be completed in a so-called stopless manner.

As the mandatory condition for the stopless operation, it is necessary that the sheet set removal from one bin module will have been completed, emptying thereby the bin module, by the time the sorting for the other bin module will be completed.

While the invention has been described with reference to the structures disclosed herein, it is not confined to the details set forth, and this application is intended to cover such modifications or changes as may coma within the purposes of the improvements or the scope of the following claims.

What is claimed is:

1. An image forming apparatus comprising:

a original stacking tray capable of stacking a plurality of originals;

feeding means for feeding the originals one by one;

means for detecting sizes of the originals;

image forming means for reading an image of the original and for forming an image on a sheet having a size corresponding to a size of the original;

means for folding the sheet on which the image is formed by said image forming means;

stacking means for stacking a sheet folded or not folded by said folding means; and control means operative in a mixed original mode in which the originals on said stacking tray have different sizes, wherein in the mixed original mode, said control means effects the image formations on the sheets having sizes corresponding to the original sizes detected by said detecting means and automatically selects, when the size of the sheet is large, a folding mode to operate the folding means to fold the sheet into the size of a not folded sheet.

2. An apparatus according to claim 1, wherein said original size detecting means is provided in a path for the originals fed by feeding means.

3. An apparatus according to claim 2, wherein the originals having been read by said image forming means are returned to said original stacking tray, and can be refed.

4. An apparatus according to claim 1, wherein when the sheet is not folded, the sheet is discharged through a path different from the path for the folded sheet.

5. An apparatus according to claim 1, further comprising a mixed orignal mode selector wherein the mixed mode is selected by operation of said mixed original mode selector.

6. An apparatus according to claim 5, wherein said original size detecting means detects the size of the original for a first one of the originals in a normal mode, and detects the sizes for all originals in the mixed size mode.

7. An apparatus according to claim 6, wherein in the mixed original mode, the sizes of the originals are checked, and properness of use of the mixed original mode is discriminated, and if use thereof is not proper, the normal mode is used.

8. An apparatus according to claim 7, wherein the sizes of the originals are checked while the originals are fed idly, before starting image formation.

9. An apparatus according to claim 7, wherein the sizes of the originals are detected by a sensor on the original tray, before starting image formation.

10. An apparatus according to claim 7, further comprising a mixed original mode selector for selecting the mixed original mode, and second control means for checking sizes of the originals while feeding the originals idly, wherein if the mixed original mode is not proper, the mixed original mode is canceled even if the mixed original mode is selected.

11. An apparatus according to claim 1, wherein the mixed original mode is selected by idly feeding the originals and checking the size of the originals.

12. An apparatus according to any one of claims 1–10, further comprising a binding means for binding a set of sheets.

13. An apparatus according to any one of claims 1–10, wherein said stacking means is a sorter having a plurality of bin trays.

14. An apparatus according to any one of claims 1–10, further comprising binding means for binding a set of sheets on said stacking means, and stacker means for stacking a set of bound sheets, and wherein the stacking means is a sorter having a plurality of bin trays.

15. An image forming apparatus comprising:

a original stacking tray capable of stacking a plurality of originals;

feeding means for feeding the originals one by one;

means for detecting sizes of the originals;

image forming means for reading an image of the original and for forming an image on a sheet having a size corresponding to a size of the original;

means for folding the sheet on which the image is formed by said image forming means;

stacking means for stacking the sheet, folded or not folded by said folding means; and control means for effecting the image formations on the sheets having sizes corresponding to the sizes of the originals detected by said detecting means and automatically selecting, when the size of the sheet is large, a folding mode to operate the folding means to fold the sheet into the size of a not folded sheet.

16. An apparatus according to claim 15, wherein said original size detecting means is provided in a path for the originals fed by said feeding means.

17. An apparatus according to claim 16, wherein the originals having been read by said image forming means are returned to said original stacking tray, and can be refed.

18. An apparatus according to claim 15, wherein when a sheet is not folded, the sheet is discharged through a path different from a path for a folded sheet.

19. An apparatus according to any one of claims 15 through 18, further comprising a binding means for binding a set of sheets.

20. An apparatus according to any one of claims 15 through 18, wherein said stacking means is a sorter having a plurality of bin trays.

21. An apparatus according to any one of claims 15 through 18, further comprising binding means for binding a set of sheets on said stacking means, and stacker means for stacking a set of bound sheets, and wherein the stacking means is a sorter having a plurality of bin trays.

* * * * *

UNITED STATES PATENT AND TRADEMARK OFFICE

CERTIFICATE OF CORRECTION

PATENT NO. : 5,918,101

DATED : June 29, 1999

INVENTOR(S) : SATOSHI KUROYANGI

It is certified that error appears in the above-identified patent and that said Letters Patent is hereby corrected as shown below:

ON THE COVER:

Section [56] References Cited:

"02152864 6/1990 Japan" should read --2-152864 6/1990 Japan--;

"03183596 8/1991 Japan" should read --3-183596 8/1991 Japan;

"03184064 8/1991 Japan" should be deleted; and

"03184065 8/1991 Japan" should be deleted.

UNITED STATES PATENT AND TRADEMARK OFFICE

CERTIFICATE OF CORRECTION

PATENT NO. : 5,918,101

DATED : June 29, 1999

INVENTOR(S) : SATOSHI KUROYANGI

It is certified that error appears in the above-identified patent and that said Letters Patent is hereby corrected as shown below:

ON THE COVER:

Section [57] ABSTRACT:

Line 1, "a" should read --an--; and
Line 15, "sized" should read --sizes--.

COLUMN 2:

Line 2, "moans," should read --means,--; and
Line 39, "site," should read --size,--.

COLUMN 3:

Line 7, "can" should read --can be--.

COLUMN 6:

Line 33, "sheet set" should read --sheet set--.

COLUMN 9:

Line 18, "525" should read --B25--;
Line 20, "224" should read --B24--;
Line 64, close up right margin; and
Line 65, close up left margin.

UNITED STATES PATENT AND TRADEMARK OFFICE

CERTIFICATE OF CORRECTION

PATENT NO. : 5,918,101

DATED : June 29, 1999

INVENTOR(S) : SATOSHI KUROYANGI

It is certified that error appears in the above-identified patent and that said Letters Patent is hereby corrected as shown below:

COLUMN 10:

Line 12, "get" should read --set--.

COLUMN 12:

Line 1, "described" should read --described.--; and
Line 43, "Is" should read --is--.

COLUMN 14:

Line 52, "oh" should read --on--; and
Line 57, "and" should read --end--.

COLUMN 19:

Line 13, "coma" should read --come--.

UNITED STATES PATENT AND TRADEMARK OFFICE

CERTIFICATE OF CORRECTION

PATENT NO. : 5,918,101

DATED : June 29, 1999

INVENTOR(S) : SATOSHI KUROYANGI

It is certified that error appears in the above-identified patent and that said Letters Patent is hereby corrected as shown below:

Column 19, Line 18, "a" (first occurrence) should read --an--.

Column 20, Line 24, "a" (first occurrence) should read --an--.

Signed and Sealed this

Twenty-second Day of August, 2000

*Attest:*

Q. TODD DICKINSON

*Attesting Officer*

*Director of Patents and Trademarks*